US007571511B2

(12) United States Patent
Jones et al.

(10) Patent No.: US 7,571,511 B2
(45) **Date of Patent: *Aug. 11, 2009**

(54) AUTONOMOUS FLOOR-CLEANING ROBOT

(75) Inventors: Joseph L. Jones, Acton, MA (US); Newton E. Mack, Somerville, MA (US); David M. Nugent, Newport, RI (US); Paul E. Sandin, Randolph, MA (US)

(73) Assignee: iRobot Corporation, Bedford, MA (US)

( * ) Notice: Subject to any disclaimer, the term of this patent is extended or adjusted under 35 U.S.C. 154(b) by 867 days.

This patent is subject to a terminal disclaimer.

(21) Appl. No.: 10/818,073

(22) Filed: Apr. 5, 2004

(65) Prior Publication Data

US 2004/0187249 A1 Sep. 30, 2004

Related U.S. Application Data

(63) Continuation of application No. 10/320,729, filed on Dec. 16, 2002, now Pat. No. 6,883,201.

(60) Provisional application No. 60/345,764, filed on Jan. 3, 2002.

(51) Int. Cl.
*A47L 9/28* (2006.01)

(52) U.S. Cl. ..... 15/319; 15/340.4

(58) Field of Classification Search ..... 15/319, 15/340.4; *A47L 5/00, 9/00, 11/00, 9/28, A47L 11/24*

See application file for complete search history.

(56) References Cited

U.S. PATENT DOCUMENTS

| | | | |
|---|---|---|---|
| 3,457,575 | A | 7/1969 | Bienek |
| 3,550,714 | A | 12/1970 | Bellinger |
| 3,674,316 | A | 7/1972 | De Brey |
| 3,937,174 | A | 2/1976 | Haaga |
| 4,099,284 | A | 7/1978 | Shinozaki et al. |
| 4,119,900 | A | 10/1978 | Kremnitz |
| 4,306,329 | A | 12/1981 | Yokoi |
| 4,369,543 | A | 1/1983 | Chen et al. |
| 4,513,469 | A | 4/1985 | Godfrey et al. |

(Continued)

FOREIGN PATENT DOCUMENTS

| | | |
|---|---|---|
| DE | 198 49 978 C2 | 2/2001 |

(Continued)

OTHER PUBLICATIONS

Gat, Erann, Robust Low-computation Sensor-driven Control for Task-Directed Navigation, Proceedings of the 1991 IEEE, International Conference on Robotics and Automation, Sacramento, California, Apr. 1991, pp. 2484-2489.

(Continued)

*Primary Examiner*—David A Redding
(74) *Attorney, Agent, or Firm*—Fish & Richardson P.C.

(57) ABSTRACT

An autonomous floor-cleaning robot comprises a self-adjusting cleaning head subsystem that includes a dual-stage brush assembly having counter-rotating, asymmetric brushes and an adjacent, but independent, vacuum assembly such that the cleaning capability and efficiency of the self-adjustable cleaning head subsystem is optimized while concomitantly minimizing the power requirements thereof. The autonomous floor-cleaning robot further includes a side brush assembly for directing particulates outside the envelope of the robot into the self-adjusting cleaning head subsystem.

62 Claims, 13 Drawing Sheets

U.S. PATENT DOCUMENTS

| | | | | |
|---|---|---|---|---|
| 4,556,313 | A | | 12/1985 | Miller et al. |
| 4,626,995 | A | | 12/1986 | Lofgren et al. |
| 4,674,048 | A | | 6/1987 | Okumura |
| 4,679,152 | A | | 7/1987 | Perdue |
| 4,696,074 | A | | 9/1987 | Cavalli et al. |
| 4,700,427 | A | | 10/1987 | Knepper |
| 4,716,621 | A | | 1/1988 | Zoni |
| 4,733,430 | A | | 3/1988 | Westergren |
| 4,733,431 | A | | 3/1988 | Martin |
| 4,756,049 | A | | 7/1988 | Uehara |
| 4,777,416 | A | | 10/1988 | George, II et al. |
| 4,782,550 | A | | 11/1988 | Jacobs |
| 4,811,228 | A | | 3/1989 | Hyyppa |
| 4,815,157 | A | | 3/1989 | Tsuchiya |
| 4,854,000 | A | | 8/1989 | Takimoto |
| 4,887,415 | A | | 12/1989 | Martin |
| 4,893,025 | A | | 1/1990 | Lee |
| 4,901,394 | A | | 2/1990 | Nakamura et al. |
| 4,912,643 | A | | 3/1990 | Beirne |
| 4,919,224 | A | | 4/1990 | Shyu et al. |
| 4,933,864 | A | | 6/1990 | Evans et al. |
| 4,956,891 | A | | 9/1990 | Wulff |
| 4,962,453 | A | | 10/1990 | Pong et al. |
| 4,974,283 | A | | 12/1990 | Holsten et al. |
| 5,002,145 | A | | 3/1991 | Wakaumi et al. |
| 5,020,186 | A | | 6/1991 | Lessig et al. |
| 5,084,934 | A | | 2/1992 | Lessig et al. |
| 5,086,535 | A | | 2/1992 | Grossmeyer et al. |
| 5,093,955 | A | | 3/1992 | Blehert et al. |
| 5,105,502 | A | | 4/1992 | Takashima |
| 5,109,566 | A | | 5/1992 | Kobayashi et al. |
| 5,115,538 | A | | 5/1992 | Cochran et al. |
| 5,136,750 | A | | 8/1992 | Takashima et al. |
| 5,142,985 | A | | 9/1992 | Stearns et al. |
| 5,165,064 | A | | 11/1992 | Mattaboni |
| 5,204,814 | A | | 4/1993 | Noonan et al. |
| 5,208,521 | A | | 5/1993 | Aoyama |
| 5,239,720 | A | | 8/1993 | Wood et al. |
| 5,261,139 | A | | 11/1993 | Lewis |
| 5,279,672 | A | | 1/1994 | Betker, Jr. et al. |
| 5,284,522 | A | | 2/1994 | Kobayashi et al. |
| 5,293,955 | A | | 3/1994 | Lee |
| 5,303,448 | A | | 4/1994 | Hennessey et al. |
| 5,309,592 | A | * | 5/1994 | Hiratsuka ..... 15/49.1 |
| 5,319,828 | A | | 6/1994 | Waldhauser et al. |
| 5,321,614 | A | | 6/1994 | Ashworth |
| 5,324,948 | A | | 6/1994 | Dudar et al. |
| 5,341,540 | A | | 8/1994 | Soupert et al. |
| 5,353,224 | A | | 10/1994 | Lee et al. |
| 5,369,347 | A | | 11/1994 | Yoo |
| 5,440,216 | A | | 8/1995 | Kim |
| 5,444,965 | A | | 8/1995 | Colens |
| 5,446,356 | A | | 8/1995 | Kim |
| 5,454,129 | A | | 10/1995 | Kell |
| 5,455,982 | A | | 10/1995 | Armstrong et al. |
| 5,465,525 | A | | 11/1995 | Mifune et al. |
| 5,467,273 | A | | 11/1995 | Faibish et al. |
| 5,497,529 | A | | 3/1996 | Boesi |
| 5,507,067 | A | | 4/1996 | Hoekstra et al. |
| 5,515,572 | A | | 5/1996 | Hoekstra et al. |
| 5,534,762 | A | | 7/1996 | Kim |
| 5,537,017 | A | | 7/1996 | Feiten et al. |
| 5,539,953 | A | | 7/1996 | Kurz |
| 5,542,146 | A | | 8/1996 | Hoekstra et al. |
| 5,548,511 | A | | 8/1996 | Bancroft |
| 5,553,349 | A | | 9/1996 | Kilstrom et al. |
| 5,555,587 | A | | 9/1996 | Guha |
| 5,560,077 | A | | 10/1996 | Crotchett |
| 5,568,589 | A | | 10/1996 | Hwang |
| 5,608,944 | A | | 3/1997 | Gordon |
| 5,611,106 | A | | 3/1997 | Wulff |
| 5,611,108 | A | | 3/1997 | Knowlton et al. |
| 5,613,261 | A | | 3/1997 | Kawakami et al. |
| 5,621,291 | A | | 4/1997 | Lee |
| 5,622,236 | A | | 4/1997 | Azumi et al. |
| 5,634,237 | A | | 6/1997 | Paranjpe |
| 5,634,239 | A | | 6/1997 | Tuvin et al. |
| 5,650,702 | A | | 7/1997 | Azumi |
| 5,652,489 | A | | 7/1997 | Kawakami |
| 5,682,313 | A | | 10/1997 | Edlund et al. |
| 5,709,007 | A | | 1/1998 | Chiang |
| 5,761,762 | A | | 6/1998 | Kubo et al. |
| 5,781,960 | A | | 7/1998 | Kilstrom et al. |
| 5,787,545 | A | * | 8/1998 | Colens ..... 15/319 |
| 5,794,297 | A | | 8/1998 | Muta |
| 5,812,267 | A | | 9/1998 | Everett, Jr. et al. |
| 5,815,880 | A | | 10/1998 | Nakanishi |
| 5,839,156 | A | | 11/1998 | Park et al. |
| 5,841,259 | A | | 11/1998 | Kim et al. |
| 5,867,800 | A | | 2/1999 | Leif |
| 5,926,909 | A | | 7/1999 | McGee |
| 5,935,179 | A | | 8/1999 | Kleiner et al. |
| 5,940,927 | A | | 8/1999 | Haegermarck et al. |
| 5,940,930 | A | | 8/1999 | Oh et al. |
| 5,942,869 | A | | 8/1999 | Katou et al. |
| 5,943,730 | A | | 8/1999 | Boomgaarden |
| 5,943,733 | A | | 8/1999 | Tagliaferri |
| 5,959,423 | A | | 9/1999 | Nakanishi et al. |
| 5,974,348 | A | | 10/1999 | Rocks |
| 6,030,465 | A | | 2/2000 | Marcussen et al. |
| 6,038,501 | A | | 3/2000 | Kawakami |
| 6,041,471 | A | | 3/2000 | Charky et al. |
| 6,076,025 | A | | 6/2000 | Ueno et al. |
| 6,076,226 | A | | 6/2000 | Reed |
| 6,226,830 | B1 | | 5/2001 | Hendriks et al. |
| 6,240,342 | B1 | | 5/2001 | Fiegert et al. |
| 6,255,793 | B1 | | 7/2001 | Peless et al. |
| 6,259,979 | B1 | | 7/2001 | Holmquist |
| 6,261,379 | B1 | | 7/2001 | Conrad et al. |
| 6,327,741 | B1 | | 12/2001 | Reed |
| 6,339,735 | B1 | | 1/2002 | Peless et al. |
| 6,370,453 | B2 | | 4/2002 | Sommer |
| 6,381,802 | B2 | | 5/2002 | Park |
| 6,389,329 | B1 | | 5/2002 | Colens |
| 6,444,003 | B1 | | 9/2002 | Sutcliffe |
| 6,457,206 | B1 | | 10/2002 | Judson |
| 6,459,955 | B1 | | 10/2002 | Bartsch et al. |
| 6,463,368 | B1 | | 10/2002 | Feiten et al. |
| 6,465,982 | B1 | | 10/2002 | Bergvall et al. |
| 6,481,515 | B1 | | 11/2002 | Kirkpatrick et al. |
| 6,493,612 | B1 | | 12/2002 | Bisset et al. |
| 6,493,613 | B2 | | 12/2002 | Peless et al. |
| 6,496,754 | B2 | | 12/2002 | Song et al. |
| 6,496,755 | B2 | | 12/2002 | Wallach et al. |
| 6,525,509 | B1 | | 2/2003 | Petersson et al. |
| 6,532,404 | B2 | | 3/2003 | Colens |
| 6,571,415 | B2 | | 6/2003 | Gerber et al. |
| 6,574,536 | B1 | | 6/2003 | Kawagoe et al. |
| 6,580,246 | B2 | | 6/2003 | Jacobs |
| 6,601,265 | B1 | | 8/2003 | Burlington |
| 6,605,156 | B1 | | 8/2003 | Clark et al. |
| 6,611,120 | B2 | | 8/2003 | Song et al. |
| 6,611,738 | B2 | | 8/2003 | Ruffner |
| 6,615,108 | B1 | | 9/2003 | Peless et al. |
| 6,658,693 | B1 | | 12/2003 | Reed, Jr. |
| 6,671,592 | B1 | | 12/2003 | Bisset et al. |
| 6,690,134 | B1 | | 2/2004 | Jones et al. |
| 6,741,054 | B2 | | 5/2004 | Koselka et al. |
| 6,748,297 | B2 | | 6/2004 | Song et al. |
| 6,781,338 | B2 | | 8/2004 | Jones et al. |
| 6,809,490 | B2 | | 10/2004 | Jones et al. |
| 6,830,120 | B1 | | 12/2004 | Yashima et al. |
| 6,841,963 | B2 | | 1/2005 | Song et al. |
| 6,883,201 | B2 | | 4/2005 | Jones et al. |

| | | | |
|---|---|---|---|
| 6,901,624 | B2 | 6/2005 | Mori et al. |
| D510,066 | S | 9/2005 | Hickey et al. |
| 6,938,298 | B2 | 9/2005 | Aasen |
| 6,956,348 | B2 | 10/2005 | Landry et al. |
| 6,965,209 | B2 | 11/2005 | Jones et al. |
| 6,971,140 | B2 | 12/2005 | Kim |
| 6,999,850 | B2 | 2/2006 | McDonald |
| 7,013,527 | B2 * | 3/2006 | Thomas et al. ..... 15/319 |
| 7,024,278 | B2 | 4/2006 | Chiappetta et al. |
| 7,085,624 | B2 | 8/2006 | Aldred et al. |
| 7,206,677 | B2 | 4/2007 | Hulden |
| 2001/0047231 | A1 | 11/2001 | Peless et al. |
| 2002/0011813 | A1 | 1/2002 | Koselka et al. |
| 2002/0016649 | A1 | 2/2002 | Jones |
| 2002/0120364 | A1 | 8/2002 | Colens |
| 2002/0156556 | A1 | 10/2002 | Ruffner |
| 2002/0173877 | A1 | 11/2002 | Zweig |
| 2003/0019071 | A1 | 1/2003 | Field et al. |
| 2003/0025472 | A1 | 2/2003 | Jones et al. |
| 2003/0060928 | A1 | 3/2003 | Abramson et al. |
| 2003/0120389 | A1 | 6/2003 | Abramson et al. |
| 2003/0137268 | A1 | 7/2003 | Papanikolopoulos et al. |
| 2003/0192144 | A1 | 10/2003 | Song et al. |
| 2003/0216834 | A1 | 11/2003 | Allard |
| 2003/0233177 | A1 | 12/2003 | Johnson et al. |
| 2004/0020000 | A1 | 2/2004 | Jones |
| 2004/0030448 | A1 | 2/2004 | Solomon |
| 2004/0030449 | A1 | 2/2004 | Solomon |
| 2004/0030450 | A1 | 2/2004 | Solomon |
| 2004/0030571 | A1 | 2/2004 | Solomon |
| 2004/0031113 | A1 | 2/2004 | Wosewick et al. |
| 2004/0049877 | A1 | 3/2004 | Jones et al. |
| 2004/0068351 | A1 | 4/2004 | Solomon |
| 2004/0068415 | A1 | 4/2004 | Solomon |
| 2004/0068416 | A1 | 4/2004 | Solomon |
| 2004/0076324 | A1 | 4/2004 | Burl et al. |
| 2004/0088079 | A1 | 5/2004 | Lavarec et al. |
| 2004/0111184 | A1 | 6/2004 | Chiappetta et al. |
| 2004/0134336 | A1 | 7/2004 | Solomon |
| 2004/0134337 | A1 | 7/2004 | Solomon |
| 2004/0156541 | A1 | 8/2004 | Jeon et al. |
| 2004/0158357 | A1 | 8/2004 | Lee et al. |
| 2004/0200505 | A1 | 10/2004 | Taylor et al. |
| 2004/0204792 | A1 | 10/2004 | Taylor et al. |
| 2004/0211444 | A1 | 10/2004 | Taylor et al. |
| 2004/0236468 | A1 | 11/2004 | Taylor et al. |
| 2004/0244138 | A1 | 12/2004 | Taylor et al. |
| 2005/0000543 | A1 | 1/2005 | Taylor et al. |
| 2005/0010331 | A1 | 1/2005 | Taylor et al. |
| 2005/0156562 | A1 | 7/2005 | Cohen et al. |
| 2005/0204717 | A1 | 9/2005 | Colens |

FOREIGN PATENT DOCUMENTS

| | | | |
|---|---|---|---|
| EP | 1 331 537 | A1 | 7/2003 |
| EP | 1 331 537 | B1 | 7/2003 |
| FR | 2 828 589 | | 8/2001 |
| GB | 2 283 838 | | 5/1995 |
| JP | 62-120510 | | 6/1987 |
| JP | 60259895 | | 6/1987 |
| JP | 62-154008 | | 7/1987 |
| JP | 60293095 | | 7/1987 |
| JP | 62154008 | | 7/1987 |
| JP | 63/183032 | | 7/1988 |
| JP | 63-183032 | | 7/1988 |
| JP | 63-241610 | | 10/1988 |
| JP | 62074018 | | 10/1988 |
| JP | 2-6312 | | 1/1990 |
| JP | 2/6312 | | 1/1990 |
| JP | 02-283343 | | 11/1990 |
| JP | 03-051023 | | 3/1991 |
| JP | 3-51023 | A | 3/1991 |
| JP | 6/3251 | | 1/1994 |
| JP | 06-327598 | | 11/1994 |
| JP | 6-327598 | A | 11/1994 |
| JP | 7-129239 | A | 5/1995 |
| JP | 7-295636 | | 11/1995 |
| JP | 7/295636 | | 11/1995 |
| JP | 08-089451 | | 4/1996 |
| JP | 8-89451 | A | 4/1996 |
| JP | 08-152916 | | 6/1996 |
| JP | 8-152916 | A | 6/1996 |
| JP | 9-179625 | | 7/1997 |
| JP | 07338573 | | 7/1997 |
| JP | 08000393 | | 7/1997 |
| JP | 9185410 | | 7/1997 |
| JP | 09-206258 | | 8/1997 |
| JP | 2555263 | | 8/1997 |
| JP | 08016776 | | 8/1997 |
| JP | 09043901 | | 9/1998 |
| JP | 11-508810 | | 8/1999 |
| JP | 11/510935 | | 9/1999 |
| JP | 11-510935 | | 9/1999 |
| JP | 11162454 | | 12/2000 |
| JP | 2001-087182 | | 4/2001 |
| JP | 2001-258807 | | 9/2001 |
| JP | 2001-258807 | A | 9/2001 |
| JP | 2001-275908 | | 10/2001 |
| JP | 2001-275908 | A | 10/2001 |
| JP | 2001/525567 | | 12/2001 |
| JP | 2001-525567 | | 12/2001 |
| JP | 2002-78650 | | 3/2002 |
| JP | 2002-78650 | A | 3/2002 |
| JP | 2002/204768 | | 7/2002 |
| JP | 2002-204768 | | 7/2002 |
| JP | 2002-532178 | | 10/2002 |
| JP | 2002-532178 | A | 10/2002 |
| JP | 3356170 | | 10/2002 |
| JP | 2002/323925 | | 11/2002 |
| JP | 2002-323925 | | 11/2002 |
| JP | 3375843 | | 11/2002 |
| JP | 2002-355206 | | 12/2002 |
| JP | 2002-355206 | A | 12/2002 |
| JP | 2002-360471 | | 12/2002 |
| JP | 2002-360471 | A | 12/2002 |
| JP | 2002-360482 | | 12/2002 |
| JP | 2002-360482 | A | 12/2002 |
| JP | 2003-10076 | | 1/2003 |
| JP | 2003-10076 | A | 1/2003 |
| JP | 2003-5296 | | 2/2003 |
| JP | 2003-036116 | | 2/2003 |
| JP | 2003/036116 | | 2/2003 |
| JP | 2003-38401 | | 2/2003 |
| JP | 2003-38401 | A | 2/2003 |
| JP | 2003-38402 | | 2/2003 |
| JP | 2003-38402 | A | 2/2003 |
| JP | 2003/052596 | | 2/2003 |
| JP | 2003-505127 | | 2/2003 |
| JP | 2003-505127 | A | 2/2003 |
| JP | 2003036116 | | 2/2003 |
| JP | 2003-061882 | | 3/2003 |
| JP | 2003/061882 | | 3/2003 |
| JP | 2003-310489 | | 11/2003 |
| WO | WO 95/26512 | | 10/1995 |
| WO | WO 97/15224 | | 5/1997 |
| WO | WO 97/40734 | | 11/1997 |
| WO | WO 97/41451 | | 11/1997 |
| WO | WO 99/16078 | | 4/1999 |
| WO | WO 99/28800 | | 6/1999 |
| WO | WO 99/38056 | | 7/1999 |
| WO | WO 99/38237 | | 7/1999 |
| WO | WO 99/43250 | | 9/1999 |
| WO | WO 99/59042 | | 11/1999 |
| WO | WO 00/04430 | | 1/2000 |
| WO | WO 00/36962 | | 6/2000 |
| WO | WO 00/38026 | | 6/2000 |

| | | | |
|---|---|---|---|
| WO | WO 00/38029 | | 6/2000 |
| WO | WO 00/78410 | | 12/2000 |
| WO | WO 00/78410 | A1 | 12/2000 |
| WO | WO 01/06904 | | 2/2001 |
| WO | WO 01/06904 | A1 | 2/2001 |
| WO | WO 01/06905 | | 2/2001 |
| WO | WO 02/39864 | | 5/2002 |
| WO | WO 02/39864 | A1 | 5/2002 |
| WO | WO 02/39868 | | 5/2002 |
| WO | WO 02/39868 | A1 | 5/2002 |
| WO | WO 02/058527 | | 8/2002 |
| WO | WO 02/058527 | A1 | 8/2002 |
| WO | WO 02/062194 | | 8/2002 |
| WO | WO 02/067744 | | 9/2002 |
| WO | WO 02/067744 | A1 | 9/2002 |
| WO | WO 02/067745 | | 9/2002 |
| WO | WO 02/067745 | A1 | 9/2002 |
| WO | WO 02/074150 | | 9/2002 |
| WO | WO 02/074150 | A1 | 9/2002 |
| WO | WO 02/075356 | | 9/2002 |
| WO | WO 02/075356 | A1 | 9/2002 |
| WO | WO 02/075469 | | 9/2002 |
| WO | WO 02/075469 | A1 | 9/2002 |
| WO | WO 02/075470 | | 9/2002 |
| WO | WO 02/075470 | A1 | 9/2002 |
| WO | WO 02/101477 | | 12/2002 |
| WO | WO 03/026474 | | 4/2003 |
| WO | WO 03/026474 | A2 | 4/2003 |
| WO | WO 03/040845 | | 5/2003 |
| WO | WO 03/040845 | A1 | 5/2003 |
| WO | WO 03/040846 | | 5/2003 |
| WO | WO 03/040846 | A1 | 5/2003 |
| WO | WO 2004/006034 | | 1/2004 |
| WO | WO 2004004533 | A1 | 1/2004 |
| WO | WO 2004058028 | A2 | 1/2004 |
| WO | WO2005077244 | A1 | 1/2004 |
| WO | WO2006068403 | A1 | 1/2004 |
| WO | WO 2005/055795 | | 6/2005 |

OTHER PUBLICATIONS

Schofield, Monica, "Neither Master nor Slave . . . " A Practical Case Study in the Development and Employment of Cleaning Robots, Emerging Technologies and Factory Automation, 1999, Proceedings, EFA '99. 1999 7th IEEE International Conference on Barcelona, Spain Oct. 18-21, 1999, pp. 1427-1434.

Doty, Keith L. et al., "Sweep Strategies for a Sensory-Driven, Behavior-Based Vacuum Cleaning Agent" AAAI 1993 Fall Symposium Series Instantiating Real-World Agents Research Triangle Park, Raleigh, NC, Oct. 22-24, 1993, pp. 1-6.

Karcher RC 3000 Cleaning Robot—user manual. Manufacturer: Alfred Karcher GmbH & Co., Cleaning Systems, Alfred-Karcher-Str. 28-40, P.O. Box 160, D-71349 Winnenden, Germany, Dec. 2002.

Cameron Morland, *Autonomous Lawn Mower Control*, Jul. 24, 2002.

Doty, Keith L et al, "Sweep Strategies for a Sensory-Driven, Behavior-Based Vacuum Cleaning Agent" AAAI 1993 Fall Symposium Series Instantiating Real-World Agents Research Triangle Park, Raleigh, NC, Oct. 22-24, 1993.

Electrolux designed for the well-lived home, website: http://www.electroluxusa.com/node57.as[?currentURL=node142.asp%3F, acessed Mar. 18, 2005, 2 pages.

eVac Robotic Vacuum S1727 Instruction Manual, Sharper Image Corp, Copyright 2004, 14 pages.

Everyday Robots, website: http://www.everydayrobots.com/index.php?option=content&task=view&id=9, accessed Apr. 20, 2005.

Facts on the Trilobite webpage: "http://trilobiteelectroluxse/presskit_en/nodel1335asp?print=yes&pressID=" accessed Dec. 12, 2003.

Friendly Robotics Robotic Vacuum RV400-The Robot Store website: http://www.therobotstore.com/s.nl/sc.9/category,-109/it.A/id.43/.f, accessed Apr. 20, 2005.

Hitachi: News release: The home cleaning robot of the autonomous movement type (experimental machine) is developed, website: http://www.i4u.com/japanreleases/hitachirobot.htm., accessed Mar. 18, 2005.

Kärcher Product Manual Download webpage: "http://ww-wkarchercom/bta/downloadenshtml?ACTION=SELECTTEILENR&ID=rc3000&subunitButtonName=Select+Product+Manual" and associated pdf file "5959-915enpdf (47 MB) English/English" accessed Jan. 21, 2004.

Karcher RC 3000 Cleaning Robot—user manual Manufacturer: Alfred-Karcher GmbH & Co, Cleaning Systems, Alfred Karcher-Str 28-40, PO Box 160, D-71349 Winnenden, Germany, Dec. 2002.

Kärcher RoboCleaner RC 3000 Product Details webpages: "http://wwwrobocleanerde/english/screen3html" through . . . screen6html accessed Dec. 12, 2003.

Karcher USA, RC3000 Robotic Cleaner, website: http://www.karcher-usa.com/showproducts.php?op=view_prod&param1=143&param2=&param3=, accessed Mar. 18, 2005.

Koolvac Robotic Vacuum Cleaner Owner's Manual, Koolatron, Undated.

NorthStar Low-Cost, Indoor Localization, Evolution robotics, Powering Intelligent Products.

Put Your Roomba . . . On "Automatic" Roomba Timer> Timed Cleaning-Floorvac Robotic Vacuum webpages: http://cgi.ebay.com/ws/eBayISAPI.dll?ViewItem&category=43575198387&rd=1, accessed Apr. 20, 2005.

Put Your Roomba . . . On "Automatic" webpages: "http://www.acomputeredge.com/roomba," accessed Apr. 20, 2005.

RoboMaid Sweeps Your Floors So You Won't Have To, the Official Site, website: http://www.thereobomaid.com/, acessed Mar. 18, 2005.

Robot Review Samsung Robot Vacuum (VC-RP30W), website: http://www.onrobo.com/reviews/At_Home/Vacuun_Cleaners/on00vcrp30/rosam/index.htm, accessed Mar. 18, 2005.

Robotic Vacuum Cleaner, website: http://www.sharperimage.com/us/en/catalog/productview.jhtml?sku=S1727BLU, accessed Mar. 18, 2005.

Schofield, Monica, "Neither Master nor Slave" A Practical Study in the Development and Employment of Cleaning Robots, Emerging Technologies and Factory Automation, 1999 Proceedings EFA'99 1999 7th IEEE International Conference on Barcelona, Spain Oct. 18-21, 1999, pp. 1427-1434.

Wired News: Robot Vacs Are in the House, website: http://www.wired.com/news/print/0,1294,59237,00.html, accessed Mar. 18, 2005.

Zoombot Remote Controlled Vacuum-RV-500 New Roomba 2, website: http://cgi.ebay.com/ws/eBayISAPI.dll?ViewItem&category=43526&item=4373497618&rd=1, accessed Apr. 20, 2005.

* cited by examiner

AUTONOMOUS FLOOR-CLEANING ROBOT

CROSS-REFERENCE TO RELATED APPLICATIONS

This application for U.S. Patent is a continuation of, and claims priority from, U.S. patent application Ser. No. 10/320,729 filed Dec. 16, 2002, entitled Autonomous Floor-Cleaning Robot and U.S. Provisional Application Ser. No. 60/345,764 filed Jan. 3, 2002, entitled Cleaning Mechanisms for Autonomous Robot. The subject matter of this application is also related to commonly-owned, co-pending U.S. patent application Ser. Nos. 09/768,773, filed Jan. 24, 2001, entitled Robot Obstacle Detection System; 10/167,851, filed Jun. 12, 2002, entitled Method and System for Robot Localization and Confinement; and, 10/056,804, filed Jan. 24, 2002, entitled Method and System for Multi-Mode Coverage for an Autonomous Robot.

BACKGROUND OF THE INVENTION (1) Field of the Invention

The present invention relates to cleaning devices, and more particularly, to an autonomous floor-cleaning robot that comprises a self-adjustable cleaning head subsystem that includes a dual-stage brush assembly having counter-rotating, asymmetric brushes and an adjacent, but independent, vacuum assembly such that the cleaning capability and efficiency of the self-adjustable cleaning head subsystem is optimized while concomitantly minimizing the power requirements thereof. The autonomous floor-cleaning robot further includes a side brush assembly for directing particulates outside the envelope of the robot into the self-adjustable cleaning head subsystem.

(2) Description of Related Art

Autonomous robot cleaning devices are known in the art. For example, U.S. Pat. Nos. 5,940,927 and 5,781,960 disclose an Autonomous Surface Cleaning Apparatus and a Nozzle Arrangement for a Self-Guiding Vacuum Cleaner. One of the primary requirements for an autonomous cleaning device is a self-contained power supply—the utility of an autonomous cleaning device would be severely degraded, if not outright eliminated, if such an autonomous cleaning device utilized a power cord to tap into an external power source.

And, while there have been distinct improvements in the energizing capabilities of self-contained power supplies such as batteries, today's self-contained power supplies are still time-limited in providing power. Cleaning mechanisms for cleaning devices such as brush assemblies and vacuum assemblies typically require large power loads to provide effective cleaning capability. This is particularly true where brush assemblies and vacuum assemblies are configured as combinations, since the brush assembly and/or the vacuum assembly of such combinations typically have not been designed or configured for synergic operation.

A need exists to provide an autonomous cleaning device that has been designed and configured to optimize the cleaning capability and efficiency of its cleaning mechanisms for synergic operation while concomitantly minimizing or reducing the power requirements of such cleaning mechanisms.

SUMMARY OF THE INVENTION

One object of the present invention is to provide a cleaning device that is operable without human intervention to clean designated areas.

Another object of the present invention is to provide such an autonomous cleaning device that is designed and configured to optimize the cleaning capability and efficiency of its cleaning mechanisms for synergic operations while concomitantly minimizing the power requirements of such mechanisms.

These and other objects of the present invention are provided by one embodiment autonomous floor-cleaning robot according to the present invention that comprises a housing infrastructure including a chassis, a power subsystem; for providing the energy to power the autonomous floor-cleaning robot, a motive subsystem operative to propel the autonomous floor-cleaning robot for cleaning operations, a control module operative to control the autonomous floor-cleaning robot to effect cleaning operations, and a self-adjusting cleaning head subsystem that includes a deck mounted in pivotal combination with the chassis, a brush assembly mounted in combination with the deck and powered by the motive subsystem to sweep up particulates during cleaning operations, a vacuum assembly disposed in combination with the deck and powered by the motive subsystem to ingest particulates during cleaning operations, and a deck height adjusting subassembly mounted in combination with the motive subsystem for the brush assembly, the deck, and the chassis that is automatically operative in response to a change in torque in said brush assembly to pivot the deck with respect to said chassis and thereby adjust the height of the brushes from the floor. The autonomous floor-cleaning robot also includes a side brush assembly mounted in combination with the chassis and powered by the motive subsystem to entrain particulates outside the periphery of the housing infrastructure and to direct such particulates towards the self-adjusting cleaning head subsystem.

BRIEF DESCRIPTION OF THE DRAWINGS

A more complete understanding of the present invention and the attendant features and advantages thereof may be had by reference to the following detailed description of the invention when considered in conjunction with the accompanying drawings wherein.

DETAILED DESCRIPTION OF THE INVENTION

Figure 1:
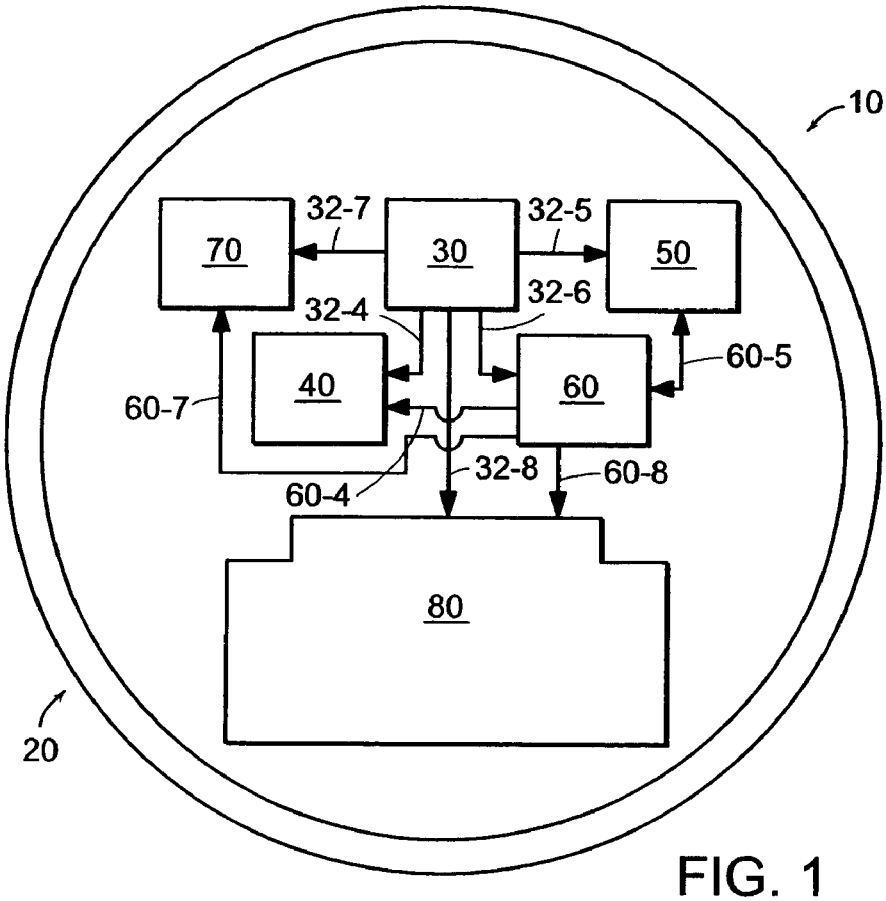
FIG. 1 is a schematic representation of an autonomous floor-cleaning robot according to the present invention.

Referring now to the drawings where like reference numerals identify corresponding or similar elements throughout the several views, FIG. 1 is a schematic representation of an autonomous floor-cleaning robot 10 according to the present invention. The robot 10 comprises a housing infrastructure 20, a power subsystem 30, a motive subsystem 40, a sensor subsystem 50, a control module 60, a side brush assembly 70, and a self-adjusting cleaning head subsystem 80. The power subsystem 30, the motive subsystem 40, the sensor subsystem 50, the control module 60, the side brush assembly 70, and the self-adjusting cleaning head subsystem 80 are integrated in combination with the housing infrastructure 20 of the robot 10 as described in further detail in the following paragraphs.

In the following description of the autonomous floor-cleaning robot 10, use of the terminology "forward/fore" refers to the primary direction of motion of the autonomous floor-cleaning robot 10, and the terminology fore-aft axis (see reference characters "FA" in FIGS. 3A, 3B) defines the forward direction of motion (indicated by arrowhead of the fore-aft axis FA), which is coincident with the fore-aft diameter of the robot 10.

Referring to FIGS. 2, 2A, and 3A-3C, the housing infrastructure 20 of the robot 10 comprises a chassis 21, a cover 22, a displaceable bumper 23, a nose wheel subassembly 24, and a carrying handle 25. The chassis 21 is preferably molded from a material such as plastic as a unitary element that includes a plurality of preformed wells, recesses, and structural members for, inter alia, mounting or integrating elements of the power subsystem 30, the motive subsystem 40, the sensor subsystem 50, the side brush assembly 70, and the self-adjusting cleaning head subsystem 80 in combination with the chassis 21. The cover 22 is preferably molded from a material such as plastic as a unitary element that is complementary in configuration with the chassis 21 and provides protection of and access to elements/components mounted to the chassis 21 and/or comprising the self-adjusting cleaning head subsystem 80. The chassis 21 and the cover 22 are detachably integrated in combination by any suitable means, e.g., screws, and in combination, the chassis 21 and cover 22 form a structural envelope of minimal height having a generally cylindrical configuration that is generally symmetrical along the fore-aft axis FA.

The displaceable bumper 23, which has a generally arcuate configuration, is mounted in movable combination at the forward portion of the chassis 21 to extend outwardly therefrom, i.e., the normal operating position. The mounting configuration of the displaceable bumper is such that the bumper 23 is displaced towards the chassis 21 (from the normal operating position) whenever the bumper 23 encounters a stationary object or obstacle of predetermined mass, i.e., the displaced position, and returns to the normal operating position when contact with the stationary object or obstacle is terminated (due to operation of the control module 60 which, in response to any such displacement of the bumper 23, implements a "bounce" mode that causes the robot 10 to evade the stationary object or obstacle and continue its cleaning routine, e.g., initiate a random—or weighted-random—turn to resume forward movement in a different direction). The mounting configuration of the displaceable bumper 23 comprises a pair of rotatable support members 23RSM, which are operative to facilitate the movement of the bumper 23 with respect to the chassis 21.

The pair of rotatable support members 23RSM are symmetrically mounted about the fore-aft axis FA of the autonomous floor-cleaning robot 10 proximal the center of the displaceable bumper 23 in a V-configuration. One end of each support member 23RSM is rotatably mounted to the chassis 21 by conventional means, e.g., pins/dowel and sleeve arrangement, and the other end of each support member 23RSM is likewise rotatably mounted to the displaceable bumper 23 by similar conventional means. A biasing spring (not shown) is disposed in combination with each rotatable support member 23RSM and is operative to provide the biasing force necessary to return the displaceable bumper 23 (through rotational movement of the support members 23RSM) to the normal operating position whenever contact with a stationary object or obstacle is terminated.

The embodiment described herein includes a pair of bumper arms 23BA that are symmetrically mounted in parallel about the fore-aft diameter FA of the autonomous floor-cleaning robot 10 distal the center of the displaceable bumper 23. These bumper arms 23BA do not per se provide structural support for the displaceable bumper 23, but rather are a part of the sensor subsystem 50 that is operative to determine the location of a stationary object or obstacle encountered via the bumper 23. One end of each bumper arm 23BA is rigidly secured to the displaceable bumper 23 and the other end of each bumper arm 23BA is mounted in combination with the chassis 21 in a manner, e.g., a slot arrangement such that, during an encounter with a stationary object or obstacle, one or both bumper arms 23BA are linearly displaceable with respect to the chassis 21 to activate an associated sensor, e.g., IR break beam sensor, mechanical switch, capacitive sensor, which provides a corresponding signal to the control module 60 to implement the "bounce" mode. Further details regarding the operation of this aspect of the sensor subsystem 50, as well as alternative embodiments of sensors having utility in detecting contact with or proximity to stationary objects or obstacles can be found in commonly-owned, co-pending U.S. patent application Ser. No. 10/056,804, filed 24 Jan. 2002, entitled Method and System for Multi-Mode Coverage for an Autonomous Robot.

The nose-wheel subassembly 24 comprises a wheel 24W rotatably mounted in combination with a clevis member 24CM that includes a mounting shaft. The clevis mounting shaft 24CM is disposed in a well in the chassis 21 at the forward end thereof on the fore-aft diameter of the autonomous floor-cleaning robot 10. A biasing spring 24BS (hidden behind a leg of the clevis member 24CM in FIG. 3C) is disposed in combination with the clevis mounting shaft 24CM and operative to bias the nose-wheel subassembly 24 to an 'extended' position whenever the nose-wheel subassembly 24 loses contact with the surface to be cleaned. During cleaning operations, the weight of the autonomous floor-cleaning robot 10 is sufficient to overcome the force exerted by the biasing spring 24BS to bias the nose-wheel subassembly 24 to a partially retracted or operating position wherein the wheel rotates freely over the surface to be cleaned. Opposed triangular or conical wings 24TW extend outwardly from the ends of the clevis member to prevent the side of the wheel from catching on low obstacle during turning movements of the autonomous floor-cleaning robot 10. The wings 24TW act as ramps in sliding over bumps as the robot turns.

Ends 25E of the carrying handle 25 are secured in pivotal combination with the cover 22 at the forward end thereof, centered about the fore-aft axis FA of the autonomous floor-cleaning robot 10. With the autonomous floor-cleaning robot 10 resting on or moving over a surface to be cleaned, the carrying handle 25 lies approximately flush with the surface of the cover 22 (the weight of the carrying handle 25, in conjunction with arrangement of the handle-cover pivot configuration, is sufficient to automatically return the carrying handle 25 to this flush position due to gravitational effects). When the autonomous floor-cleaning robot 10 is picked up by means of the carrying handle 25, the aft end of the autonomous floor-cleaning robot 10 lies below the forward end of the autonomous floor-cleaning robot 10 so that particulate debris is not dislodged from the self-adjusting cleaning head subsystem 80.

The power subsystem 30 of the described embodiment provides the energy to power individual elements/components of the motive subsystem 40, the sensor subsystem 50, the side brush assembly 70, and the self-adjusting cleaning head subsystem 80 and the circuits and components of the control module 60 via associated circuitry 32-4, 32-5, 32-7, 32-8, and 32-6, respectively (see FIG. 1) during cleaning operations. The power subsystem 30 for the described embodiment of the autonomous floor-cleaning robot 10 comprises a rechargeable battery pack 34 such as a NiMH battery pack. The rechargeable battery pack 34 is mounted in a well formed in the chassis 21 (sized specifically for mounting/retention of the battery pack 34) and retained therein by any conventional means, e.g., spring latches (not shown). The battery well is covered by a lid 34L secured to the chassis 21 by conventional means such as screws. Affixed to the lid 34L are friction pads 36 that facilitate stopping of the autonomous floor-cleaning robot 10 during automatic shutdown. The friction pads 36 aid in stopping the robot upon the robot's attempting to drive over a cliff. The rechargeable battery pack 34 is configured to provide sufficient power to run the autonomous floor-cleaning robot 10 for a period of sixty (60) to ninety (90) minutes on a full charge while meeting the power requirements of the elements/components comprising motive subsystem 40, the sensor subsystem 50, the side brush assembly 70, the self-adjusting cleaning head subsystem 80, and the circuits and components of the control module 60.

The motive subsystem 40 comprises the independent means that: (1) propel the autonomous floor-cleaning robot 10 for cleaning operations; (2) operate the side brush assembly 70; and (3) operate the self-adjusting cleaning head subsystem 80 during such cleaning operations. Such independent means includes right and left main wheel subassemblies 42A, 42B, each subassembly 42A, 42B having its own independently-operated motor $\mathbf{42}A_M$, $\mathbf{42}B_M$, respectively, an independent electric motor 44 for the side brush assembly 70, and two independent electric motors 46, 48 for the self-adjusting brush subsystem 80, one motor 46 for the vacuum assembly and one motor 48 for the dual-stage brush assembly.

The right and left main wheel subassemblies 42A, 42B are independently mounted in wells of the chassis 21 formed at opposed ends of the transverse diameter of the chassis 21 (the transverse diameter is perpendicular to the fore-aft axis FA of the robot 10). Mounting at this location provides the autonomous floor-cleaning robot 10 with an enhanced turning capability, since the main wheel subassemblies 42A, 42B motor can be independently operated to effect a wide range of turning maneuvers, e.g., sharp turns, gradual turns, turns in place.

Each main wheel subassembly 42A, 42B comprises a wheel $\mathbf{42}A_W$, $\mathbf{42}B_W$ rotatably mounted in combination with a clevis member $\mathbf{42}A_{CM}$, $\mathbf{42}B_{CM}$. Each clevis member $\mathbf{42}A_{CM}$, $\mathbf{42}B_{CM}$ is pivotally mounted to the chassis 21 aft of the wheel axis of rotation (see FIG. 3C which illustrates the wheel axis of rotation $\mathbf{42}A_{AR}$; the wheel axis of rotation for wheel subassembly 42B, which is not shown, is identical), i.e., independently suspended. The aft pivot axis $\mathbf{42}A_{PA}$, $\mathbf{42}B_{PA}$ (see FIG. 3A) of the main wheel subassemblies 42A, 42B facilitates the mobility of the autonomous floor-cleaning robot 10, i.e., pivotal movement of the subassemblies 42A, 42B through a predetermined arc. The motor $\mathbf{42}A_M$, $\mathbf{42}B_M$ associated with each main wheel subassembly 42A, 42B is mounted to the aft end of the clevis member $\mathbf{42}A_{CM}$, $\mathbf{42}B_{CM}$. One end of a tension spring $\mathbf{42}B_{TS}$ (the tension spring for the right wheel subassembly 42A is not illustrated, but is identical to the tension spring 42BTS of the left wheel subassembly 42A) is attached to the aft portion of the clevis member $\mathbf{42}B_{CM}$ and the other end of the tension spring $\mathbf{42}B_{TS}$ is attached to the chassis 21 forward of the respective wheel $\mathbf{42}A_W$, $\mathbf{42}\ B_W$.

Each tension spring is operative to rotatably bias the respective main wheel subassembly 42A, 42B (via pivotal movement of the corresponding clevis member $\mathbf{42}A_{CM}$, $\mathbf{42}B_{CM}$ through the predetermined arc) to an 'extended' position when the autonomous floor-cleaning robot 10 is removed from the floor (in this 'extended' position the wheel axis of rotation lies below the bottom plane of the chassis 21). With the autonomous floor-cleaning robot 10 resting on or moving over a surface to be cleaned, the weight of autonomous floor-cleaning robot 10 gravitationally biases each main wheel subassembly 42A, 42B into a retracted or operating position wherein axis of rotation of the wheels are approximately coplanar with bottom plane of the chassis 21. The motors $\mathbf{42}A_M$, $\mathbf{42}B_M$ of the main wheel subassemblies 42A, 42B are operative to drive the main wheels: (1) at the same speed in the same direction of rotation to propel the autonomous floor-cleaning robot 10 in a straight line, either forward or aft; (2) at different speeds (including the situation wherein one wheel is operated at zero speed) to effect turning patterns for the autonomous floor-cleaning robot 10; or (3) at the same speed in opposite directions of rotation to cause the robot 10 to turn in place, i.e., "spin on a dime".

The wheels $\mathbf{42}A_W$, $\mathbf{42}B_W$ of the main wheel subassemblies 42A, 42B preferably have a "knobby" tread configuration $\mathbf{42}A_{KT}$, $\mathbf{42}B_{KT}$. This knobby tread configuration $\mathbf{42}A_{KT}$, $\mathbf{42}B_{KT}$ provides the autonomous floor-cleaning robot 10 with enhanced traction, particularly when traversing smooth surfaces and traversing between contiguous surfaces of different textures, e.g., bare floor to carpet or vice versa. This knobby tread configuration $\mathbf{42}A_{KT}$, $\mathbf{42}B_{KT}$ also prevents tufted fabric of carpets/rugs from being entrapped in the wheels $\mathbf{42}A_W$, 42B and entrained between the wheels and the chassis 21 during movement of the autonomous floor-cleaning robot 10. One skilled in the art will appreciate, however, that other tread patterns/configurations are within the scope of the present invention.

The sensor subsystem 50 comprises a variety of different sensing units that may be broadly characterized as either: (1) control sensing units 52; or (2) emergency sensing units 54. As the names imply, control sensing units 52 are operative to regulate the normal operation of the autonomous floor-cleaning robot 10 and emergency sensing units 54 are operative to detect situations that could adversely affect the operation of the autonomous floor-cleaning robot 10 (e.g., stairs descending from the surface being cleaned) and provide signals in response to such detections so that the autonomous floor-cleaning robot 10 can implement an appropriate response via the control module 60. The control sensing units 52 and emergency sensing units 54 of the autonomous floor-cleaning robot 10 are summarily described in the following paragraphs; a more complete description can be found in commonly-owned, co-pending U.S. patent application Ser. Nos. 09/768,773, filed 24 Jan. 2001, entitled Robot Obstacle Detection System, 10/167,851, 12 Jun. 2002, entitled Method and System for Robot Localization and Confinement, and 10/056,804, filed 24 Jan. 2002, entitled Method and System for Multi-Mode Coverage for an Autonomous Robot.

The control sensing units 52 include obstacle detection sensors 52OD mounted in conjunction with the linearly-displaceable bumper arms 23BA of the displaceable bumper 23, a wall-sensing assembly 52WS mounted in the right-hand portion of the displaceable bumper 23, a virtual wall sensing assembly 52VWS mounted atop the displaceable bumper 23 along the fore-aft diameter of the autonomous floor-cleaning robot 10, and an IR sensor/encoder combination 52WE mounted in combination with each wheel subassembly 42A, 42B.

Each obstacle detection sensor 52OD includes an emitter and detector combination positioned in conjunction with one of the linearly displaceable bumper arms 23BA so that the sensor 52OD is operative in response to a displacement of the bumper arm 23BA to transmit a detection signal to the control module 60. The wall sensing assembly 52WS includes an emitter and detector combination that is operative to detect the proximity of a wall or other similar structure and transmit a detection signal to the control module 60. Each IR sensor/encoder combination 52WE is operative to measure the rotation of the associated wheel subassembly 42A, 42B and transmit a signal corresponding thereto to the control module 60.

The virtual wall sensing assembly 52VWS includes detectors that are operative to detect a force field and a collimated beam emitted by a stand-alone emitter (the virtual wall unit—not illustrated) and transmit respective signals to the control module 60. The autonomous floor cleaning robot 10 is programmed not to pass through the collimated beam so that the virtual wall unit can be used to prevent the robot 10 from entering prohibited areas, e.g., access to a descending staircase, room not to be cleaned. The robot 10 is further programmed to avoid the force field emitted by the virtual wall unit, thereby preventing the robot 10 from overrunning the virtual wall unit during floor cleaning operations.

The emergency sensing units 54 include 'cliff detector' assemblies 54CD mounted in the displaceable bumper 23, wheeldrop assemblies 54WD mounted in conjunction with the left and right main wheel subassemblies 42A, 42B and the nose-wheel assembly 24, and current stall sensing units 54CS for the motor $\mathbf{42}A_M$, $\mathbf{42}B_M$ of each main wheel subassembly 42A, 42B and one for the motors 44, 48 (these two motors are powered via a common circuit in the described embodiment). For the described embodiment of the autonomous floor-cleaning robot 10, four (4) cliff detector assemblies 54CD are mounted in the displaceable bumper 23. Each cliff detector assembly 54CD includes an emitter and detector combination that is operative to detect a predetermined drop in the path of the robot 10, e.g., descending stairs, and transmit a signal to the control module 60. The wheeldrop assemblies 54WD are operative to detect when the corresponding left and right main wheel subassemblies 32A, 32B and/or the nose-wheel assembly 24 enter the extended position, e.g., a contact switch, and to transmit a corresponding signal to the control module 60. The current stall sensing units 54CS are operative to detect a change in the current in the respective motor, which indicates a stalled condition of the motor's corresponding components, and transmit a corresponding signal to the control module 60.

The control module 60 comprises the control circuitry (see, e.g., control lines 60-4, 60-5, 60-7, and 60-8 in FIG. 1) and microcontroller for the autonomous floor-cleaning robot 10 that controls the movement of the robot 10 during floor cleaning operations and in response to signals generated by the sensor subsystem 50. The control module 60 of the autonomous floor-cleaning robot 10 according to the present invention is preprogrammed (hardwired, software, firmware, or combinations thereof) to implement three basic operational modes, i.e., movement patterns, that can be categorized as: (1) a "spot-coverage" mode; (2) a "wall/obstacle following" mode; and (3) a "bounce" mode. In addition, the control module 60 is preprogrammed to initiate actions based upon signals received from sensor subsystem 50, where such actions include, but are not limited to, implementing movement patterns (2) and (3), an emergency stop of the robot 10, or issuing an audible alert. Further details regarding the operation of the robot 10 via the control module 60 are described in detail in commonly-owned, co-pending U.S. patent application Ser. Nos. 09/768,773, filed 24 Jan. 2001, entitled Robot Obstacle Detection System, 10/167,851, filed 12 Jun. 2002, entitled Method and System for Robot Localization and Confinement, and 10/056,804, filed 24 Jan. 2002, entitled Method and System for Multi-Mode Coverage for an Autonomous Robot.

The side brush assembly 70 is operative to entrain macroscopic and microscopic particulates outside the periphery of the housing infrastructure 20 of the autonomous floor-cleaning robot 10 and to direct such particulates towards the self-adjusting cleaning head subsystem 80. This provides the robot 10 with the capability of cleaning surfaces adjacent to baseboards (during the wall-following mode). The side brush assembly 70 is mounted in a recess formed in the lower surface of the right forward quadrant of the chassis 21 (forward of the right main wheel subassembly 42A just behind the right hand end of the displaceable bumper 23). The side brush assembly 70 comprises a shaft 72 having one end rotatably connected to the electric motor 44 for torque transfer, a hub 74 connected to the other end of the shaft 72, a cover plate 75 surrounding the hub 74, a brush means 76 affixed to the hub 74, and a set of bristles 78.

The cover plate 75 is configured and secured to the chassis 21 to encompass the hub 74 in a manner that prevents the brush means 76 from becoming stuck under the chassis 21 during floor cleaning operations.

Figure 3A:
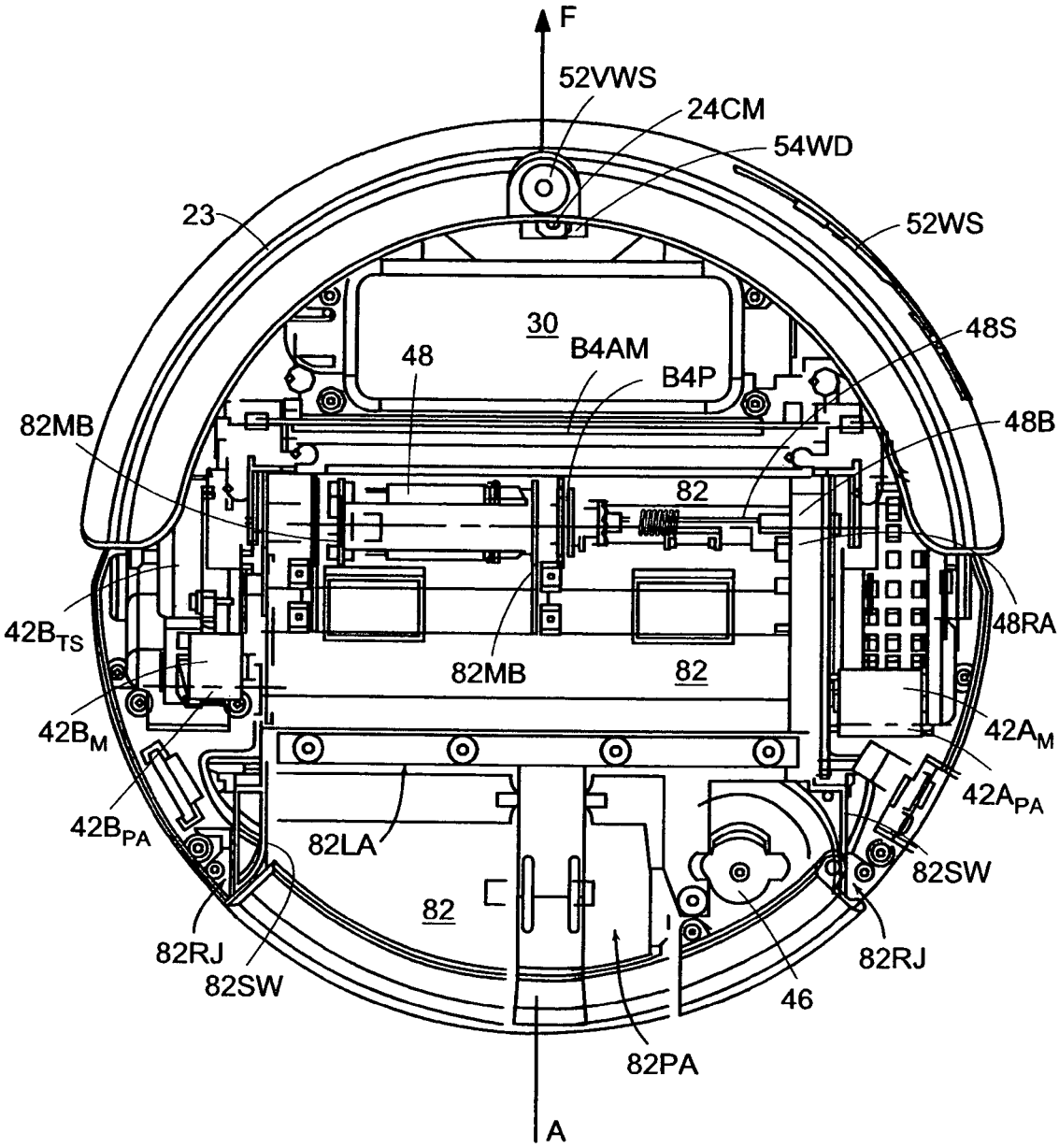
FIG. 3A is a top, partially-sectioned plan view, with cover removed, of another embodiment of an autonomous floor-cleaning robot according to the present invention.
Figure 3B:
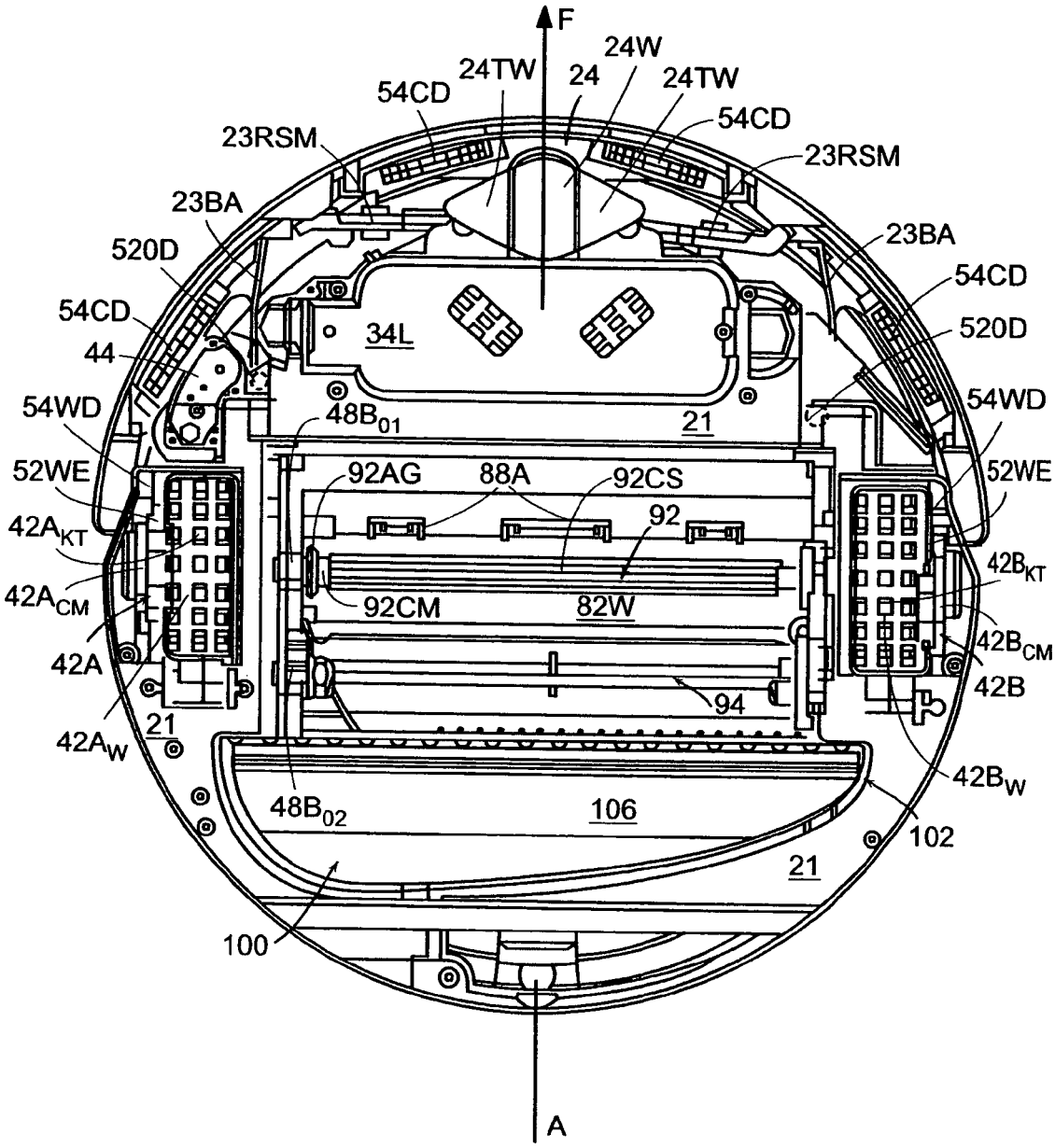
FIG. 3B is a bottom, partially-section plan view of the autonomous floor-cleaning robot embodiment of FIG. 3A.
Figure 3C:
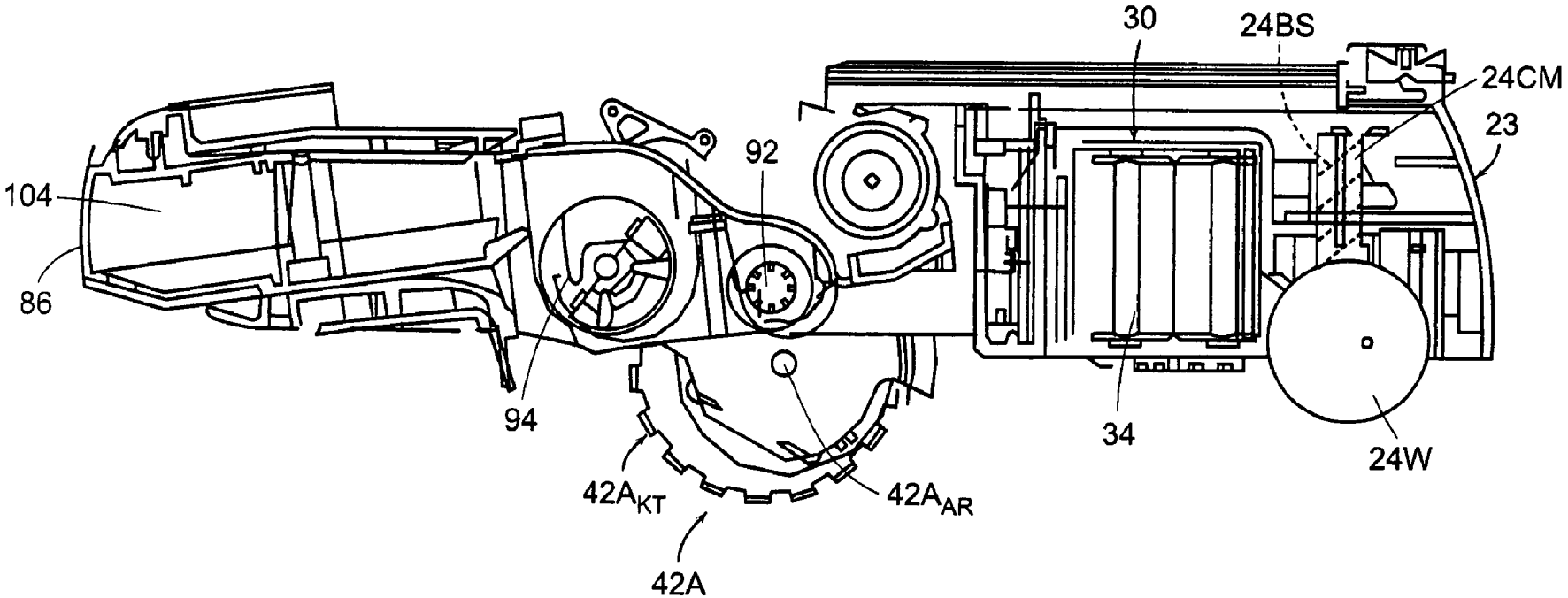
FIG. 3C is a side, partially sectioned plan view of the autonomous floor-cleaning robot embodiment of FIG. 3A.

For the embodiment of FIGS. 3A-3C, the brush means 76 comprises opposed brush arms that extend outwardly from the hub 74. These brush arms 76 are formed from a compliant plastic or rubber material in an "L"/hockey stick configuration of constant width. The configuration and composition of the brush arms 76, in combination, allows the brush arms 76 to resiliently deform if an obstacle or obstruction is temporarily encountered during cleaning operations. Concomitantly, the use of opposed brush arms 76 of constant width is a trade-off ( versus using a full or partial circular brush configuration) that ensures that the operation of the brush means 76 of the side brush assembly 70 does not adversely impact (i.e., by occlusion) the operation of the adjacent cliff detector subassembly 54CD (the left-most cliff detector subassembly 54CD in FIG. 3B) in the displaceable bumper 23. The brush arms 76 have sufficient length to extend beyond the outer periphery of the autonomous floor-cleaning robot 10, in particular the displaceable bumper 23 thereof. Such a length allows the autonomous floor-cleaning robot 10 to clean surfaces adjacent to baseboards (during the wall-following mode) without scrapping of the wall/baseboard by the chassis 21 and/or displaceable bumper 23 of the robot 10.

The set of bristles 78 is set in the outermost free end of each brush arm 76 (similar to a toothbrush configuration) to provide the sweeping capability of the side brush assembly 70. The bristles 78 have a length sufficient to engage the surface being cleaned with the main wheel subassemblies 42A, 42B and the nose-wheel subassembly 24 in the operating position.

The self-adjusting cleaning head subsystem 80 provides the cleaning mechanisms for the autonomous floor-cleaning robot 10 according to the present invention. The cleaning mechanisms for the preferred embodiment of the self-adjusting cleaning head subsystem 80 include a brush assembly 90 and a vacuum assembly 100.

For the described embodiment of FIGS. 3A-3C, the brush assembly 90 is a dual-stage brush mechanism, and this dual-stage brush assembly 90 and the vacuum assembly 100 are independent cleaning mechanisms, both structurally and functionally, that have been adapted and designed for use in the robot 10 to minimize the over-all power requirements of the robot 10 while simultaneously providing an effective cleaning capability. In addition to the cleaning mechanisms described in the preceding paragraph, the self-adjusting cleaning subsystem 80 includes a deck structure 82 pivotally coupled to the chassis 21, an automatic deck adjusting subassembly 84, a removable dust cartridge 86, and one or more bails 88 shielding the dual-stage brush assembly 90.

The deck 82 is preferably fabricated as a unitary structure from a material such as plastic and includes opposed, spaced-apart sidewalls 82SW formed at the aft end of the deck 82 (one of the sidewalls 82SW comprising a U-shaped structure that houses the motor 46, a brush-assembly well 82W, a lateral aperture 82LA formed in the intermediate portion of the lower deck surface, which defines the opening between the dual-stage brush assembly 90 and the removable dust cartridge 86, and mounting brackets 82MB formed in the forward portion of the upper deck surface for the motor 48.

The sidewalls 82SW are positioned and configured for mounting the deck 82 in pivotal combination with the chassis 21 by a conventional means, e.g., a revolute joint (see reference characters 82RJ in FIG. 3A). The pivotal axis of the deck 82—chassis 21 combination is perpendicular to the fore—aft axis FA of the autonomous floor-cleaning robot 10 at the aft end of the robot 10 (see reference character $\mathbf{82}_{PA}$ which identifies the pivotal axis in FIG. 3A).

The mounting brackets 82MB are positioned and configured for mounting the constant-torque motor 48 at the forward lip of the deck 82. The rotational axis of the mounted motor 48 is perpendicular to the fore—aft diameter of the autonomous floor-cleaning robot 10 (see reference character 48RA which identifies the rotational axis of the motor 48 in FIG. 3A). Extending from the mounted motor 48 is an shaft 48S for transferring the constant torque to the input side of a stationary, conventional dual-output gearbox 48B (the housing of the dual-output gearbox 48B is fabricated as part of the deck 82).

Figure 4A:
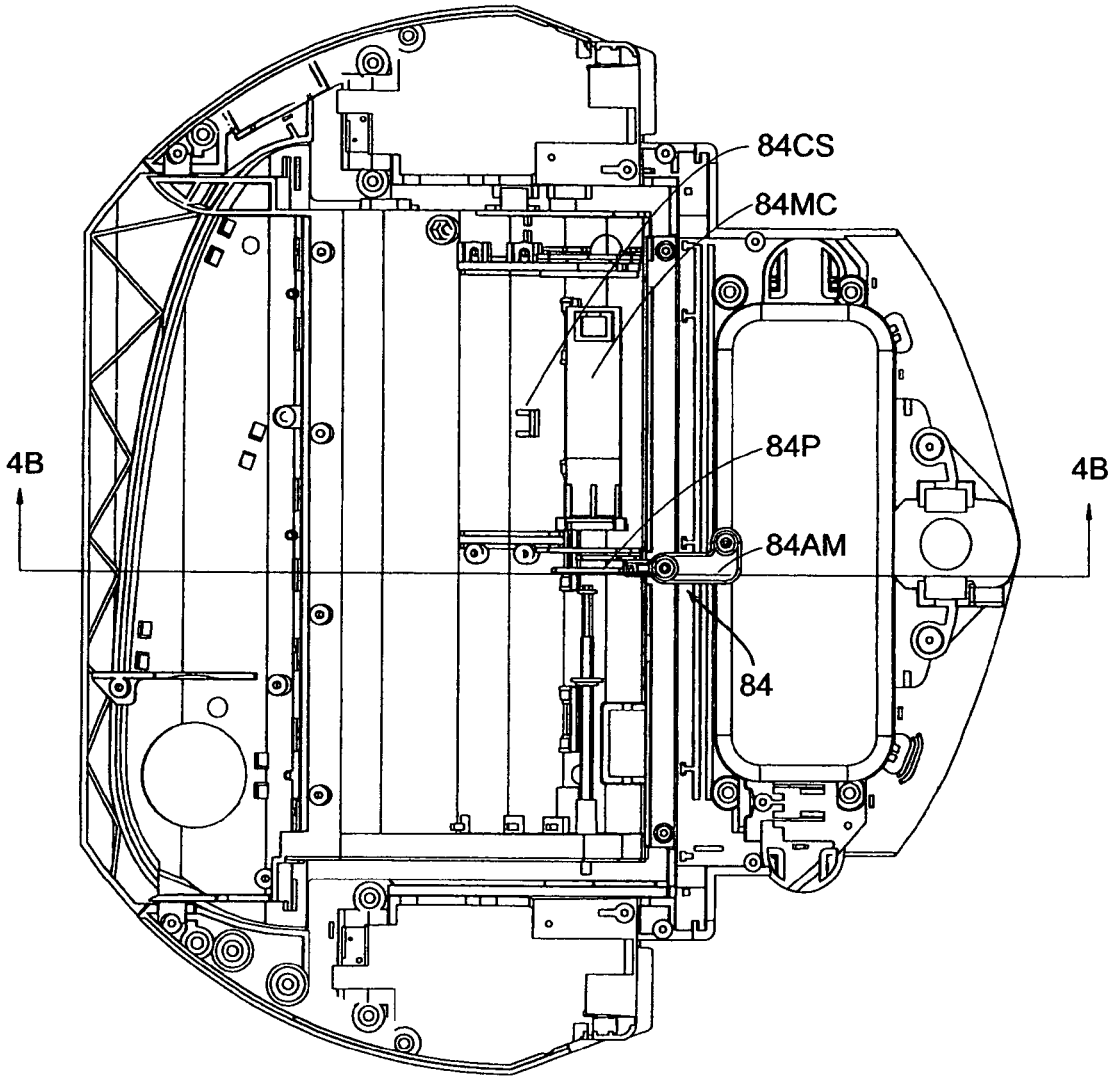
FIG. 4A is a top plan view of the deck and chassis of the autonomous floor-cleaning robot embodiment of FIG. 3A.
Figure 4B:
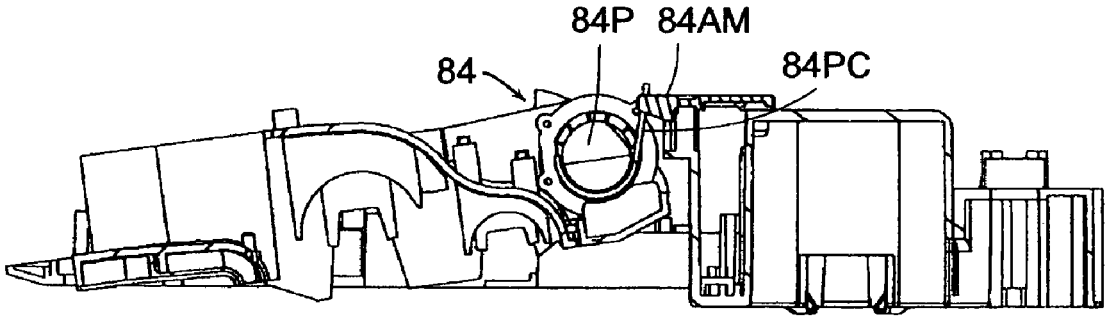
FIG. 4B is a cross-sectional view of FIG. 4A taken along line B-B thereof.
Figure 4C:
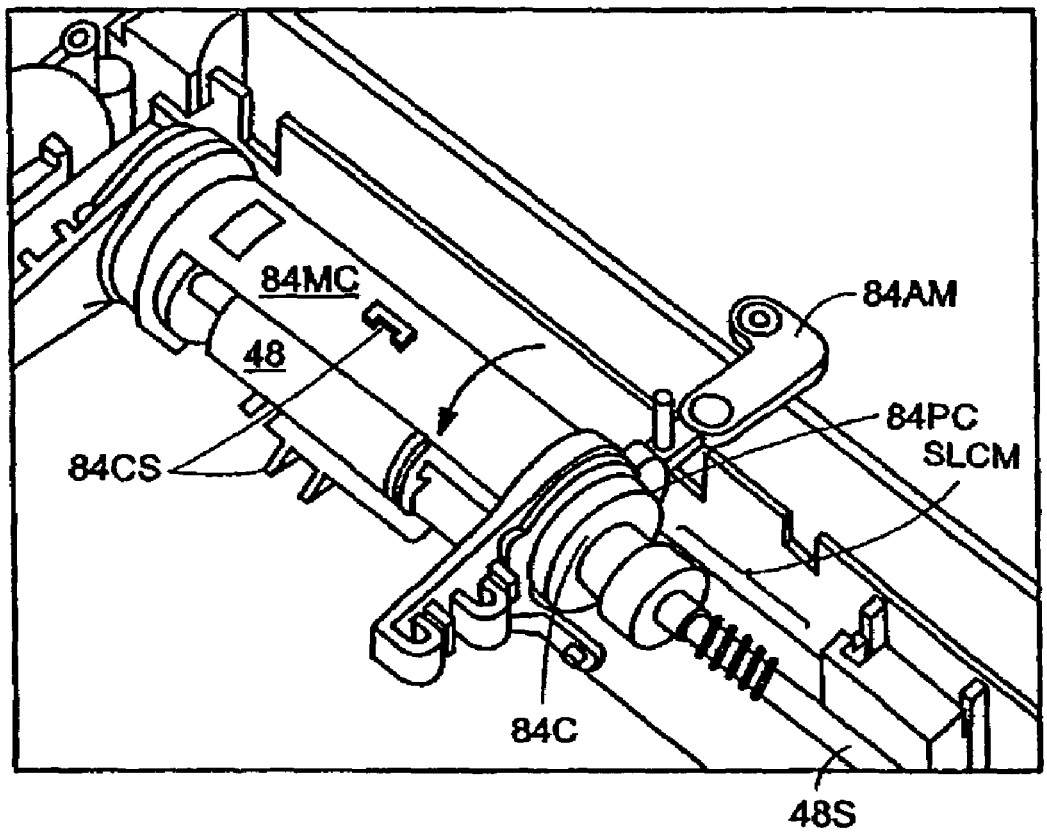
FIG. 4C is a perspective view of the deck-adjusting subassembly of autonomous floor-cleaning robot embodiment of FIG. 3A.

The desk adjusting subassembly 84, which is illustrated in further detail in FIGS. 4A-4C, is mounted in combination with the motor 48, the deck 82 and the chassis 21 and operative, in combination with the electric motor 48, to provide the physical mechanism and motive force, respectively, to pivot the deck 82 with respect to the chassis 21 about pivotal axis $\mathbf{82}_{PA}$ whenever the dual-stage brush assembly 90 encounters a situation that results in a predetermined reduction in the rotational speed of the dual-stage brush assembly 90. This situation, which most commonly occurs as the autonomous floor-cleaning robot 10 transitions between a smooth surface such as a floor and a carpeted surface, is characterized as the 'adjustment mode' in the remainder of this description.

The deck adjusting subassembly 84 for the described embodiment of FIG. 3A includes a motor cage 84MC, a pulley 84P, a pulley cord 84C, an anchor member 84AM, and complementary cage stops 84CS. The motor 48 is non-rotatably secured within the motor cage 84MC and the motor cage 84MC is mounted in rotatable combination between the mounting brackets 82MB. The pulley 84P is fixedly secured to the motor cage 84MC on the opposite side of the interior mounting bracket 82MB in such a manner that the shaft 48S of the motor 48 passes freely through the center of the pulley 84P. The anchor member 84AM is fixedly secured to the top surface of the chassis 21 in alignment with the pulley 84P.

One end of the pulley cord 84C is secured to the anchor member 84AM and the other end is secured to the pulley 84P in such a manner, that with the deck 82 in the 'down' or non-pivoted position, the pulley cord 84C is tensioned. One of the cage stops 84CS is affixed to the motor cage 84MC; the complementary cage stop 84CS is affixed to the deck 82. The complementary cage stops 84CS are in abutting engagement when the deck 82 is in the 'down' position during normal cleaning operations due to the weight of the self-adjusting cleaning head subsystem 80.

During normal cleaning operations, the torque generated by the motor 48 is transferred to the dual-stage brush subassembly 90 by means of the shaft 48S through the dual-output gearbox 48B. The motor cage assembly is prevented from rotating by the counter-acting torque generated by the pulley cord 84C on the pulley 84P. When the resistance encountered by the rotating brushes changes, the deck height will be adjusted to compensate for it. If for example, the brush torque increases as the machine rolls from a smooth floor onto a carpet, the torque output of the motor 48 will increase. In response to this, the output torque of the motor 48 will increase. This increased torque overcomes the counter-acting torque exerted by the pulley cord 84C on the pulley 84P. This causes the pulley 84P to rotate, effectively pulling itself up the pulley cord 84C. This in turn, pivots the deck about the pivot axis, raising the brushes, reducing the friction between the brushes and the floor, and reducing the torque required by the dual-stage brush subassembly 90. This continues until the torque between the motor 48 and the counter-acting torque generated by the pulley cord 84C on the pulley 84P are once again in equilibrium and a new deck height is established.

In other words, during the adjustment mode, the foregoing torque transfer mechanism is interrupted since the shaft 48S is essentially stationary. This condition causes the motor 48 to effectively rotate about the shaft 48S. Since the motor 48 is non-rotatably secured to the motor cage 84MC, the motor cage 84MC, and concomitantly, the pulley 84P, rotate with respect to the mounting brackets 82MB. The rotational motion imparted to the pulley 84P causes the pulley 84P to 'climb up' the pulley cord 84PC towards the anchor member 84AM. Since the motor cage 84MC is effectively mounted to the forward lip of the deck 82 by means of the mounting brackets 82MB, this movement of the pulley 84P causes the deck 82 to pivot about its pivot axis 82PA to an "up" position (see FIG. 4C). This pivoting motion causes the forward portion of the deck 82 to move away from surface over which the autonomous floor-cleaning robot is traversing.

Such pivotal movement, in turn, effectively moves the dual-stage brush assembly 90 away from the surface it was in contact with, thereby permitting the dual-stage brush assembly 90 to speed up and resume a steady-state rotational speed (consistent with the constant torque transferred from the motor 48). At this juncture (when the dual-stage brush assembly 90 reaches its steady-state rotational speed), the weight of the forward edge of the deck 82 (primarily the motor 48), gravitationally biases the deck 82 to pivot back to the 'down' or normal state, i.e., planar with the bottom surface of the chassis 21, wherein the complementary cage stops 84CS are in abutting engagement.

While the deck adjusting subassembly 84 described in the preceding paragraphs is the preferred pivoting mechanism for the autonomous floor-cleaning robot 10 according to the present invention, one skilled in the art will appreciate that other mechanisms can be employed to utilize the torque developed by the motor 48 to induce a pivotal movement of the deck 82 in the adjustment mode. For example, the deck adjusting subassembly could comprise a spring-loaded clutch mechanism such as that shown in FIG. 4C (identified by reference characters SLCM) to pivot the deck 82 to an "up" position during the adjustment mode, or a centrifugal clutch mechanism or a torque-limiting clutch mechanism. In other embodiments, motor torque can be used to adjust the height of the cleaning head by replacing the pulley with a cam and a constant force spring or by replacing the pulley with a rack and pinion, using either a spring or the weight of the cleaning head to generate the counter-acting torque.

The removable dust cartridge 86 provides temporary storage for macroscopic and microscopic particulates swept up by operation of the dual-stage brush assembly 90 and microscopic particulates drawn in by the operation of the vacuum assembly 100. The removable dust cartridge 86 is configured as a dual chambered structure, having a first storage chamber 86SC1 for the macroscopic and microscopic particulates swept up by the dual-stage brush assembly 90 and a second storage chamber 86SC2 for the microscopic particulates drawn in by the vacuum assembly 100. The removable dust cartridge 86 is further configured to be inserted in combination with the deck 82 so that a segment of the removable dust cartridge 86 defines part of the rear external sidewall structure of the autonomous floor-cleaning robot 10.

Figure 5A:
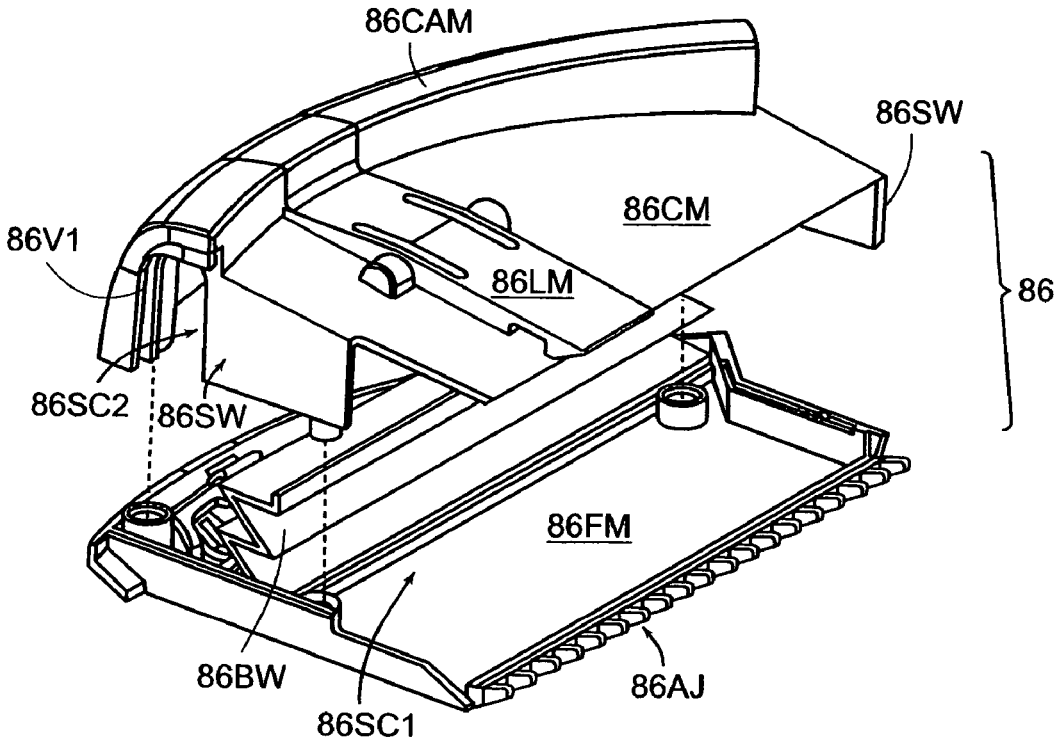
FIG. 5A is a first exploded perspective view of a dust cartridge for the autonomous floor-cleaning robot embodiment of FIG. 3A.
Figure 5B:
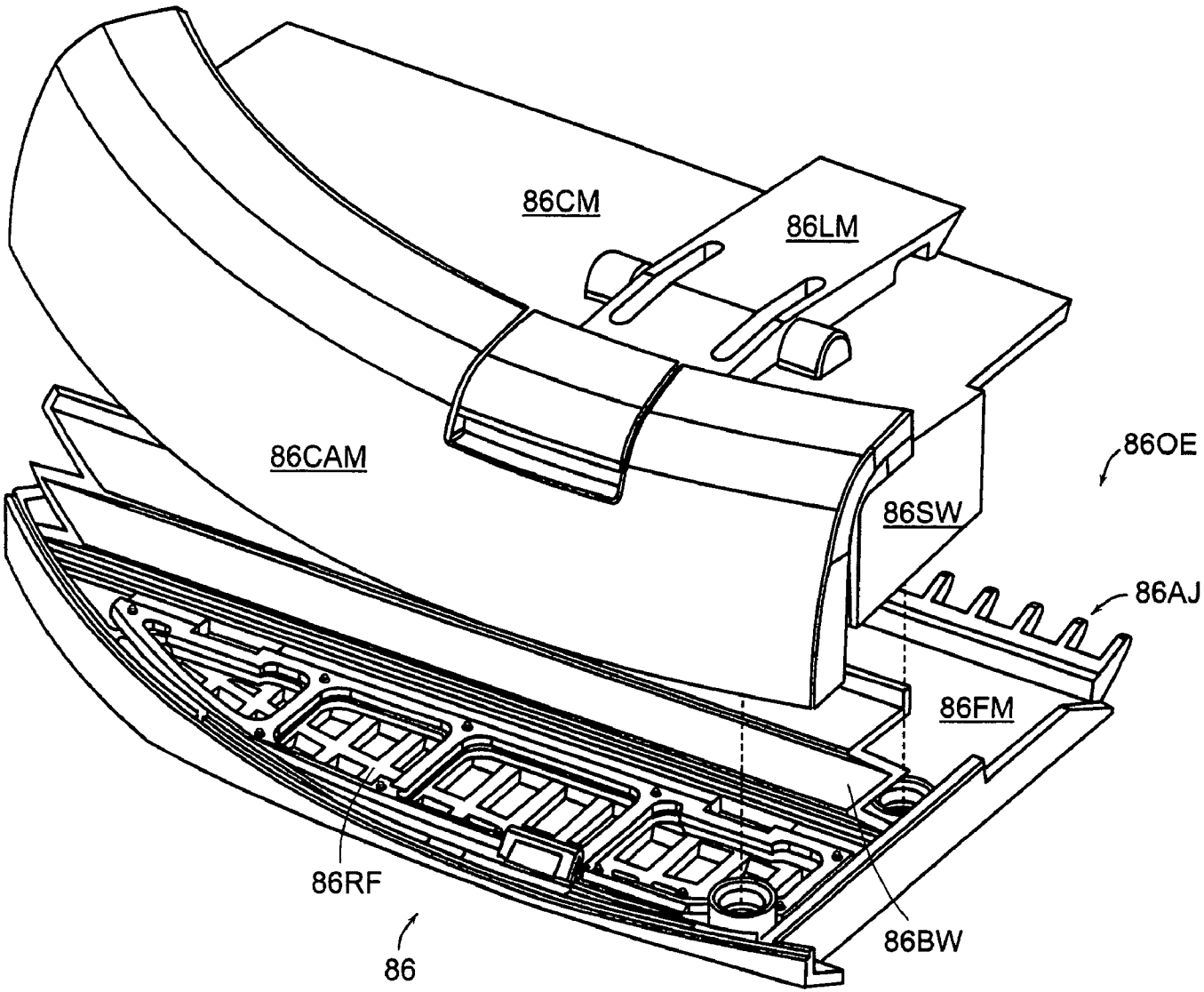
FIG. 5B is a second exploded perspective view of the dust cartridge of FIG. 5A.

As illustrated in FIGS. 5A-5B, the removable dust cartridge 86 comprises a floor member 86FM and a ceiling member 86CM joined together by opposed sidewall members 86SW. The floor member 86FM and the ceiling member 86CM extend beyond the sidewall members 86SW to define an open end 86OE, and the free end of the floor member 86FM is slightly angled and includes a plurality of baffled projections 86AJ to remove debris entrained in the brush mechanisms of the dual-stage brush assembly 90, and to facilitate insertion of the removable dust cartridge 86 in combination with the deck 82 as well as retention of particulates swept into the removable dust cartridge 86. A backwall member 86BW is mounted between the floor member 86FM and the ceiling member 86CM distal the open end 86OE in abutting engagement with the sidewall members 86SW. The backwall member 86BW has an baffled configuration for the purpose of deflecting particulates angularly therefrom to prevent particulates swept up by the dual-stage brush assembly 90 from ricocheting back into the brush assembly 90. The floor member 86FM, the ceiling member 86CM, the sidewall members 86SW, and the backwall member 86BW in combination define the first storage chamber 86SC1.

The removable dust cartridge 86 further comprises a curved arcuate member 86CAM that defines the rear external sidewall structure of the autonomous floor-cleaning robot 10. The curved arcuate member 86CAM engages the ceiling member 86CM, the floor member 86F and the sidewall members 86SW. There is a gap formed between the curved arcuate member 86CAM and one sidewall member 86SW that defines a vacuum inlet 86VI for the removable dust cartridge 86. A replaceable filter 86RF is configured for snap fit insertion in combination with the floor member 86FM. The replaceable filter 86RF, the curved arcuate member 86CAM, and the backwall member 86BW in combination define the second storage chamber 86SC1.

The removable dust cartridge 86 is configured to be inserted between the opposed spaced-apart sidewalls 82SW of the deck 82 so that the open end of the removable dust cartridge 86 aligns with the lateral aperture 82LA formed in the deck 82. Mounted to the outer surface of the ceiling member 86CM is a latch member 86LM, which is operative to engage a complementary shoulder formed in the upper surface of the deck 82 to latch the removable dust cartridge 86 in integrated combination with the deck 82.

The bail 88 comprises one or more narrow gauge wire structures that overlay the dual-stage brush assembly 90. For the described embodiment, the bail 88 comprises a continuous narrow gauge wire structure formed in a castellated configuration, i.e., alternating open-sided rectangles. Alternatively, the bail 88 may comprise a plurality of single, open-sided rectangles formed from narrow gauge wire. The bail 88 is designed and configured for press fit insertion into complementary retaining grooves 88A, 88B, respectively, formed in the deck 82 immediately adjacent both sides of the dual-stage brush assembly 90. The bail 88 is operative to shield the dual-stage brush assembly 90 from larger external objects such as carpet tassels, tufted fabric, rug edges, during cleaning operations, i.e., the bail 88 deflects such objects away from the dual-stage brush assembly 90, thereby preventing such objects from becoming entangled in the brush mechanisms.

Figure 2:
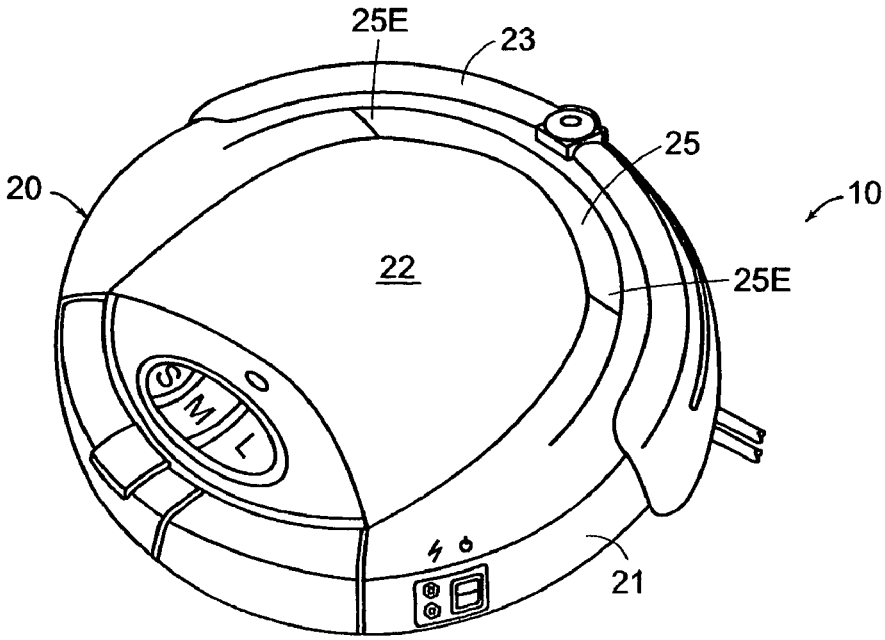
FIG. 2 is a perspective view of one embodiment of an autonomous floor-cleaning robot according to the present invention.
Figure 2A:
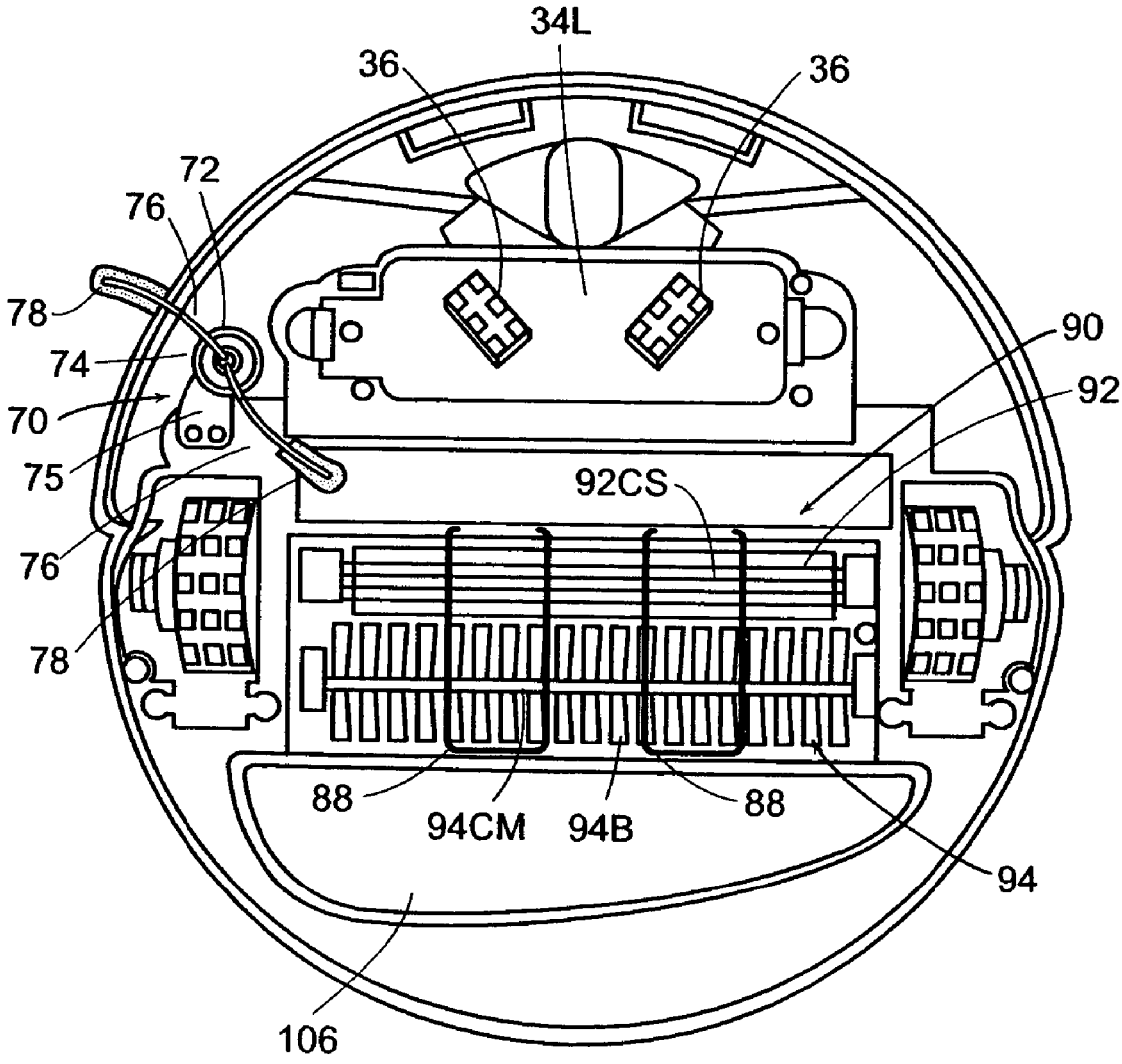
FIG. 2A is a bottom plan view of the autonomous floor-cleaning robot of FIG. 2.
Figure 6:
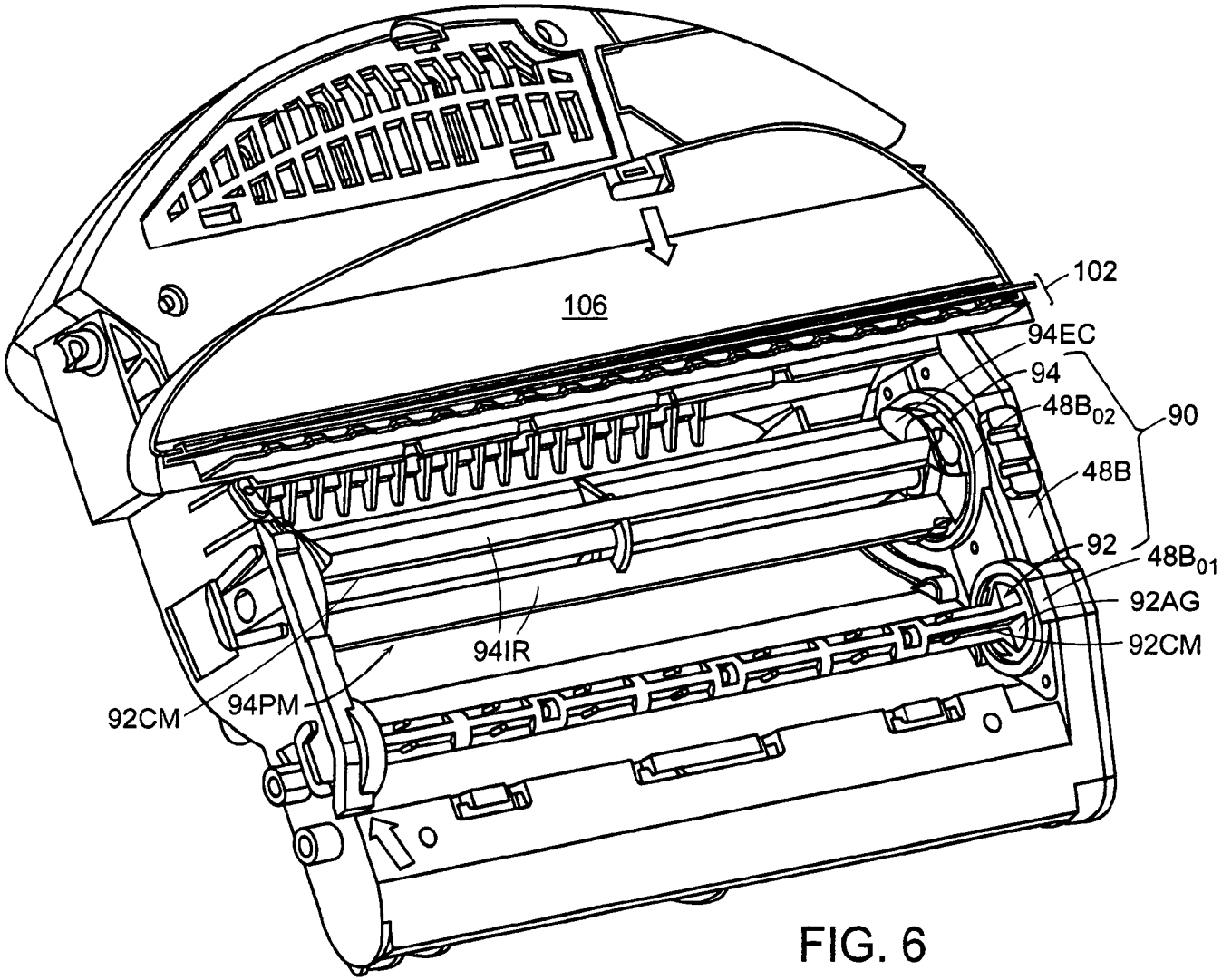
FIG. 6 is a perspective view of a dual-stage brush assembly including a flapper brush and a main brush for the autonomous floor-cleaning robot embodiment of FIG. 3A.

The dual-stage brush assembly 90 for the described embodiment of FIG. 2A comprises a flapper brush 92 and a main brush 94 that are generally illustrated in FIG. 6. structurally, the flapper brush 92 and the main brush 94 are asymmetric with respect to one another, with the main brush 94 having an O.D. greater than the O.D. of the flapper brush 92. The flapper brush 92 and the main brush 94 are mounted in the deck 82 recess, as described below in further detail, to have minimal spacing between the sweeping peripheries defined by their respective rotating elements. Functionally, the flapper brush 92 and the main brush 94 counter-rotate with respect to one another, with the flapper brush 92 rotating in a first direction that causes macroscopic particulates to be directed into the removable dust cartridge 86 and the main brush 94 rotating in a second direction, which is opposite to the forward movement of the autonomous floor-cleaning robot 10, that causes macroscopic and microscopic particulates to be directed into the removable dust cartridge 86. In addition, this rotational motion of the main brush 94 has the secondary effect of directing macroscopic and microscopic particulates towards the pick-up zone of the vacuum assembly 100 such that particulates that are not swept up by the dual-stage brush assembly 90 can be subsequently drawn up (ingested) by the vacuum assembly 100 due to movement of the autonomous floor-cleaning robot 10.

The flapper brush 92 comprises a central member 92CM having first and second ends. The first and second ends are designed and configured to mount the flapper brush 92 in rotatable combination with the deck 82 and a first output port 48$B_{O1}$ of the dual output gearbox 48B, respectively, such that rotation of the flapper brush 92 is provided by the torque transferred from the electric motor 48 (the gearbox 48B is configured so that the rotational speed of the flapper brush 92 is relative to the speed of the autonomous floor-cleaning robot 10—the described embodiment of the robot 10 has a top speed of approximately 0.9 ft/sec). In other embodiments, the flapper brush 92 rotates substantially faster than traverse speed either in relation or not in relation to the transverse speed. Axle guards 92AG having a beveled configuration are integrally formed adjacent the first and second ends of the central member 92CM for the purpose of forcing hair and other similar matter away from the flapper brush 92 to prevent such matter from becoming entangled with the ends of the central member 92CM and stalling the dual-stage brush assembly 90.

The brushing element of the flapper brush 92 comprises a plurality of segmented cleaning strips 92CS formed from a compliant plastic material secured to and extending along the central member 92CM between the internal ends of the axle guards 92AG (for the illustrated embodiment, a sleeve, configured to fit over and be secured to the central member 92CM, has integral segmented strips extending outwardly therefrom). The cleaning strips 92CS can be arranged in a linear pattern as shown in the drawings (i.e. FIG. 2A and FIG. 3B) or alternatively in a herringbone or chevron pattern.

For the described embodiment, six (6) segmented cleaning strips 92CS were equidistantly spaced circumferentially about the central member 92CM. One skilled in the art will appreciate that more or less segmented cleaning strips 92CS can be employed in the flapper brush 90 without departing from the scope of the present invention. Each of the cleaning strips 92S is segmented at prescribed intervals, such segmentation intervals depending upon the configuration (spacing) between the wire(s) forming the bail 88. The embodiment of the bail 88 described above resulted in each cleaning strip 92CS of the described embodiment of the flapper brush 92 having five (5) segments.

The main brush 94 comprises a central member 94CM (for the described embodiment the central member 94CM is a round metal member having a spiral configuration)having first and second straight ends (i.e., aligned along the centerline of the spiral). Integrated in combination with the central member 94CM is a segmented protective member 94PM. Each segment of the protective member 94PM includes opposed, spaced-apart, semi-circular end caps 94EC having integral ribs 94IR extending therebetween. For the described embodiment, each pair of semi-circular end caps EC has two integral ribs extending therebetween. The protective member 94PM is assembled by joining complementary semi-circular end caps 94EC by any conventional means, e.g., screws, such that assembled complementary end caps 94EC have a circular configuration.

The protective member 94PM is integrated in combination with the central member 94CM so that the central member 94CM is disposed along the centerline of the protective member 94PM, and with the first end of the central member 94CM terminating in one circular end cap 94EC and the second end of the central member 94CM extending through the other circular end cap 94EC. The second end of the central member 94CM is mounted in rotatable combination with the deck 82 and the circular end cap 94EC associated with the first end of the central member 94CM is designed and configured for mounting in rotatable combination with the second output port 48$B_{O2}$ of the gearbox 48B such that the rotation of the main brush 94 is provided by torque transferred from the electric motor 48 via the gearbox 48B. Bristles 94B are set in combination with the central member 94CM to extend between the integral ribs 94IR of the protective member 94PM and beyond the O.D. established by the circular end caps 94EC. The integral ribs 94IR are configured and operative to impede the ingestion of matter such as rug tassels and tufted fabric by the main brush 94.

The bristles 94B of the main brush 94 can be fabricated from any of the materials conventionally used to form bristles for surface cleaning operations. The bristles 94B of the main brush 94 provide an enhanced sweeping capability by being specially configured to provide a "flicking" action with respect to particulates encountered during cleaning operations conducted by the autonomous floor-cleaning robot 10 according to the present invention. For the described embodiment, each bristle 94B has a diameter of approximately 0.010 inches, a length of approximately 0.90 inches, and a free end having a rounded configuration. It has been determined that this configuration provides the optimal flicking action. While bristles having diameters exceeding approximately 0.014 inches would have a longer wear life, such bristles are too stiff to provide a suitable flicking action in the context of the dual-stage brush assembly 90 of the present invention. Bristle diameters that are much less than 0.010 inches are subject to premature wear out of the free ends of such bristles, which would cause a degradation in the sweeping capability of the main brush. In a preferred embodiment, the main brush is set slightly lower than the flapper brush to ensure that the flapper does not contact hard surface floors.

The vacuum assembly 100 is independently powered by means of the electric motor 46. Operation of the vacuum assembly 100 independently of the self-adjustable brush assembly 90 allows a higher vacuum force to be generated and maintained using a battery-power source than would be possible if the vacuum assembly were operated in dependence with the brush system. In other embodiments, the main brush motor can drive the vacuum. Independent operation is used herein in the context that the inlet for the vacuum assembly 100 is an independent structural unit having dimensions that are not dependent upon the "sweep area" defined by the dual-stage brush assembly 90.

Figure 7A:
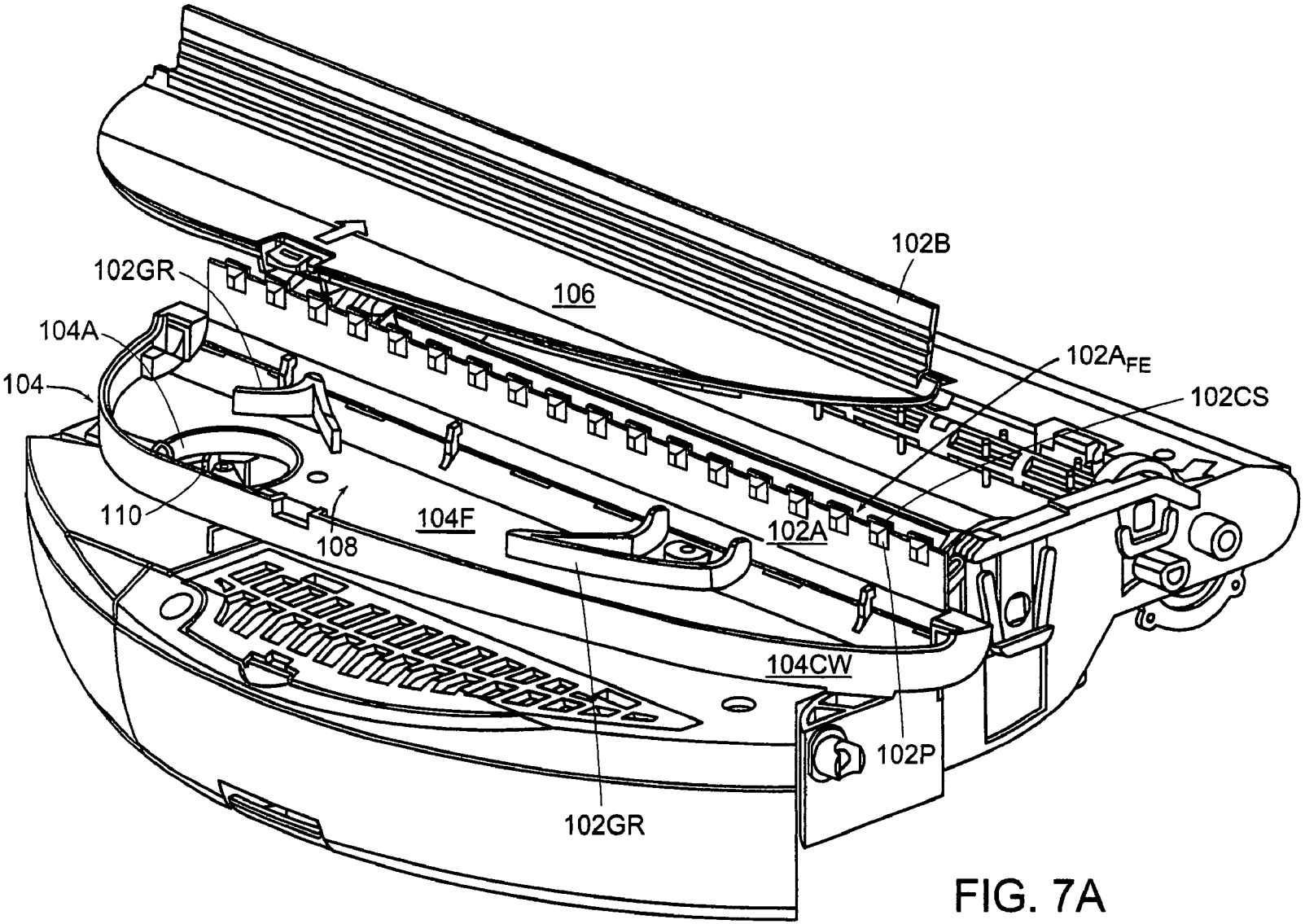
FIG. 7A is a perspective view illustrating the blades and vacuum compartment for the autonomous floor cleaning robot embodiment of FIG. 3A.
Figure 7B:
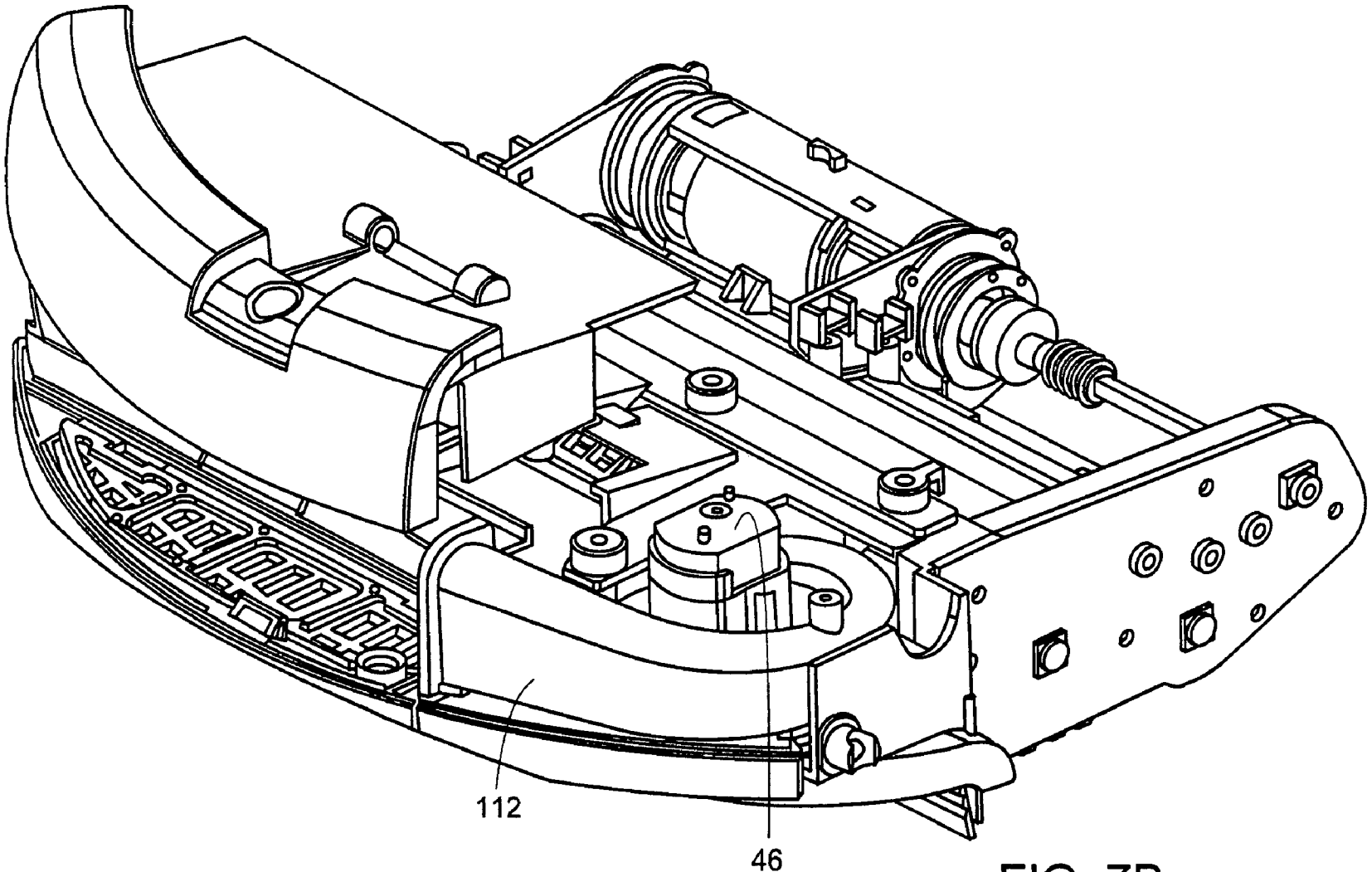
FIG. 7B is a partial perspective exploded view of the autonomous floor-cleaning robot embodiment of FIG. 7A.

The vacuum assembly 100, which is located immediately aft of the dual-stage brush assembly 90, i.e., a trailing edge vacuum, is orientated so that the vacuum inlet is immediately adjacent the main brush 94 of the dual-stage brush assembly 90 and forward facing, thereby enhancing the ingesting or vacuuming effectiveness of the vacuum assembly 100. With reference to FIGS. 7A, 7B, the vacuum assembly 100 comprises a vacuum inlet 102, a vacuum compartment 104, a compartment cover 106, a vacuum chamber 108, an impeller 110, and vacuum channel 112. The vacuum inlet 102 comprises first and second blades 102A, 102B formed of a semi-rigid/compliant plastic or elastomeric material, which are configured and arranged to provide a vacuum inlet 102 of constant size (lateral width and gap-see discussion below), thereby ensuring that the vacuum assembly 100 provides a constant air inflow velocity, which for the described embodiment is approximately 4 m/sec.

The first blade 102A has a generally rectangular configuration, with a width (lateral) dimension such that the opposed ends of the first blade 102A extend beyond the lateral dimension of the dual-stage brush assembly 90. One lateral edge of the first blade 102A is attached to the lower surface of the deck 82 immediately adjacent to but spaced apart from, the main brush 94 (a lateral ridge formed in the deck 82 provides the separation therebetween, in addition to embodying retaining grooves for the bail 88 as described above) in an orientation that is substantially symmetrical to the fore-aft diameter of the autonomous floor-cleaning robot 10. This lateral edge also extends into the vacuum compartment 104 where it is in sealed engagement with the forward edge of the compartment 104. The first blade 102A is angled forwardly with respect to the bottom surface of the deck 82 and has length such that the free end 102$A_{FE}$ of the first blade 102A just grazes the surface to be cleaned.

The free end 102$A_{FE}$ has a castellated configuration that prevents the vacuum inlet 102 from pushing particulates during cleaning operations. Aligned with the castellated segments 102CS of the free end 102$A_{FE}$, which are spaced along the width of the first blade 102A, are protrusions 102P having a predetermined height. For the prescribed embodiment, the height of such protrusions 102P is approximately 2 mm. The predetermined height of the protrusions 102P defines the "gap" between the first and second blades 102A, 102B.

The second blade 102B has a planar, unitary configuration that is complementary to the first blade 102A in width and length. The second blade 102B, however, does not have a castellated free end; instead, the free end of the second blade 102B is a straight edge. The second blade 102B is joined in sealed combination with the forward edge of the compartment cover 106 and angled with respect thereto so as to be substantially parallel to the first blade 102A. When the compartment cover 106 is fitted in position to the vacuum compartment 104, the planar surface of the second blade 102B abuts against the plurality of protrusions 102P of the first blade 102A to form the "gap" between the first and second blades 102A, 102B.

The vacuum compartment 104, which is in fluid communication with the vacuum inlet 102, comprises a recess formed in the lower surface of the deck 82. This recess includes a compartment floor 104F and a contiguous compartment wall 104CW that delineates the perimeter of the vacuum compartment 104. An aperture 104A is formed through the floor 104, offset to one side of the floor 104F. Due to the location of this aperture 104A, offset from the geometric center of the compartment floor 104F, it is prudent to form several guide ribs 104GR that project upwardly from the compartment floor 104F. These guide ribs 104GR are operative to distribute air inflowing through the gap between the first and second blades 102A, 102B across the compartment floor 104 so that a constant air inflow is created and maintained over the entire gap, i.e., the vacuum inlet 102 has a substantially constant 'negative' pressure (with respect to atmospheric pressure).

The compartment cover 106 has a configuration that is complementary to the shape of the perimeter of the vacuum compartment 104. The cover 106 is further configured to be press fitted in sealed combination with the contiguous compartment wall 104CW wherein the vacuum compartment 104 and the vacuum cover 106 in combination define the vacuum chamber 108 of the vacuum assembly 100. The compartment cover 106 can be removed to clean any debris from the vacuum channel 112. The compartment cover 106 is preferable fabricated from a clear or smoky plastic material to allow the user to visually determine when clogging occurs.

The impeller 110 is mounted in combination with the deck 82 in such a manner that the inlet of the impeller 110 is positioned within the aperture 104A. The impeller 110 is operatively connected to the electric motor 46 so that torque is transferred from the motor 46 to the impeller 110 to cause rotation thereof at a constant speed to withdraw air from the vacuum chamber 108. The outlet of the impeller 110 is integrated in sealed combination with one end of the vacuum channel 112.

The vacuum channel 112 is a hollow structural member that is either formed as a separate structure and mounted to the deck 82 or formed as an integral part of the deck 82. The other end of the vacuum channel 110 is integrated in sealed combination with the vacuum inlet 86VI of the removable dust cartridge 86. The outer surface of the vacuum channel 112 is complementary in configuration to the external shape of curved arcuate member 86CAM of the removable dust cartridge 86.

A variety of modifications and variations of the present invention are possible in light of the above teachings. For example, the preferred embodiment described above included a cleaning head subsystem 80 that was self-adjusting, i.e., the deck 82 was automatically pivotable with respect to the chassis 21 during the adjustment mode in response to a predetermined increase in brush torque of the dual-stage brush assembly 90. It will be appreciated that another embodiment of the autonomous floor-cleaning robot according to the present invention is as described hereinabove, with the exception that the cleaning head subsystem is non-adjustable, i.e., the deck is non-pivotable with respect to the chassis. This embodiment would not include the deck adjusting subassembly described above, i.e., the deck would be rigidly secured to the chassis. Alternatively, the deck could be fabricated as an integral part of the chassis—in which case the deck would be a virtual configuration, i.e., a construct to simplify the identification of components comprising the cleaning head subsystem and their integration in combination with the robot.

It is therefore to be understood that, within the scope of the appended claims, the present invention may be practiced other than as specifically described herein.

We claim:

1. A floor-cleaning robot comprising:

a wheeled housing defining a housing perimeter;

a motor drive operably connected to wheels of the housing to propel the robot across a floor surface;

an obstacle detector responsive to obstacles encountered by the robot;

a control circuit in electrical communication with both the obstacle detector and the motor drive and configured to control the motor drive to maneuver the robot to avoid detected obstacles across the floor surface during a floor-cleaning operation;

a powered primary brush assembly configured to rotate about an axis generally parallel to the floor surface disposed across a central region of an underside of the housing and positioned to brush the floor surface as the robot is propelled across the floor surface; and a powered side brush extending beyond the housing perimeter and positioned to brush floor surface debris from beyond the housing perimeter toward a projected path of the primary brush assembly.

2. The floor cleaning robot of claim 1 further comprising a vacuum with a vacuum inlet disposed in the underside of the housing and rearward of the primary brush assembly.

3. The floor cleaning robot of claim 1 further comprising a particulate receptacle positioned to receive and collect particulates ingested through the vacuum inlet.

4. The floor cleaning robot of claim 3 wherein the receptacle comprises a removable dust cartridge.

5. The floor cleaning robot of claim 2 wherein the vacuum inlet comprises an elongated slot extending across the central region of the underside of the housing.

6. The floor cleaning robot of claim 5 further comprising a first resilient blade extending from the underside of the housing immediately rearward of the vacuum inlet slot and having a distal edge configured to wipe the floor surface.

7. The floor cleaning robot of claim 6 further comprising a second resilient blade extending from the underside of the housing immediately forward of the vacuum inlet slot.

8. The floor cleaning robot of claim 1 further comprising a particulate receptacle positioned to receive and collect particulates brushed from the floor surface by the primary brush assembly.

9. The floor cleaning robot of claim 1 wherein the primary brush assembly is configured to rotate about an axis generally parallel to the floor surface and wherein the side brush is configured to rotate about an axis generally perpendicular to the floor surface.

10. The floor cleaning robot of claim 1 further comprising a cliff detector responsive to an encounter of the robot with a falling edge of the floor surface.

11. The floor cleaning robot of claim 10 wherein the control circuit is configured to redirect motion of the robot in response to detection of a floor surface falling edge.

12. The floor cleaning robot of claim 10 wherein the cliff detector is disposed adjacent a forward edge of the housing.

13. The floor cleaning robot of claim 1 further comprising at least one friction pad secured to the underside of the housing and positioned to engage the floor surface and inhibit robot motion when a forward wheel of the robot travels beyond a falling edge of the floor surface.

14. The floor cleaning robot of claim 1 wherein the obstacle detector comprises a displaceable bumper disposed at the housing perimeter, and a bumper displacement sensor responsive to displacement of the bumper with respect to the housing.

15. The floor cleaning robot of claim 14 wherein the bumper displacement sensor comprises an infrared break beam sensor.

16. The floor cleaning robot of claim 1 wherein the side brush assembly comprises bristles extending from a driven hub.

17. The floor cleaning robot of claim 16 wherein the hub has laterally extending brush arms from which the bristles extend.

18. The floor cleaning robot of claim 1 wherein the control circuit is configured to move the robot in a wall-following mode to maneuver the robot along a wall in a direction that places the side brush against the wall.

19. The floor cleaning robot of claim 1 wherein the housing perimeter is round.

20. The floor cleaning robot of claim 1 wherein the primary brush assembly comprises counter-rotating flapper and main brushes.

21. The floor cleaning robot of claim 1 wherein the primary brush assembly is mounted on a deck pivotally coupled to a portion of the housing to which the wheels are mounted.

22. The floor cleaning robot of claim 1 wherein the motor drive comprises separate motors operably connected to respective wheels of the housing, the control circuit configured to independently drive the separate motors to turn the robot.

23. The floor cleaning robot of claim 1 wherein the wheels are positioned to enable the robot to spin in place.

24. A self-propelled floor-cleaning robot comprising a housing defining a round housing perimeter;

a powered primary brush assembly disposed within the round housing perimeter and positioned to engage a floor surface;

a powered side brush extending beyond the round housing perimeter and positioned to brush floor surface debris from beyond the round housing perimeter;

an obstacle detector responsive to obstacles encountered by the robot; and a control circuit in electrical communication with the motor drive and configured to control the motor drive to maneuver the robot about detected obstacles across the floor surface during a floor-cleaning operation.

25. The floor cleaning robot of claim 24 comprising multiple side brushes spaced apart and extending beyond the housing perimeter and positioned to brush floor surface debris from beyond the round housing perimeter.

26. The floor cleaning robot of claim 24 further comprising a vacuum with a vacuum inlet disposed in the underside of the housing and rearward of the primary brush assembly.

27. The floor cleaning robot of claim 26 further comprising a particulate receptacle positioned to receive and collect particulates ingested through the vacuum inlet.

28. The floor cleaning robot of claim 27 wherein the receptacle comprises a removable dust cartridge.

29. The floor cleaning robot of claim 26 wherein the vacuum inlet comprises an elongated slot extending across the central region of the underside of the housing.

30. The floor cleaning robot of claim 29 further comprising a first resilient blade extending from the underside of the housing immediately rearward of the vacuum inlet slot and having a distal edge configured to wipe the floor surface.

31. The floor cleaning robot of claim 30 further comprising a second resilient blade extending from the underside of the housing immediately forward of the vacuum inlet slot.

32. The floor cleaning robot of claim 24 further comprising a particulate receptacle positioned to receive and collect particulates brushed from the floor surface by the primary brush assembly.

33. The floor cleaning robot of claim 24 wherein the primary brush assembly is configured to rotate about an axis generally parallel to the floor surface and wherein the side brush is configured to rotate about an axis generally perpendicular to the floor surface.

34. The floor cleaning robot of claim 24 further comprising a cliff detector responsive to an encounter of the robot with a falling edge of the floor surface.

35. The floor cleaning robot of claim 24 further comprising at least one friction pad secured to the underside of the housing and positioned to engage the floor surface and inhibit robot motion when a forward wheel of the robot travels beyond a falling edge of the floor surface.

36. The floor cleaning robot of claim 24 wherein the obstacle detector comprises a displaceable bumper disposed at the housing perimeter, and a bumper displacement sensor responsive to displacement of the bumper with respect to the housing.

37. The floor cleaning robot of claim 24 wherein the control circuit is configured to move the robot in a wall-following mode to maneuver the robot along a wall in a direction that places the side brush against the wall.

38. The floor cleaning robot of claim 24 wherein the primary brush assembly is mounted on a deck pivotally coupled to a portion of the housing to which the wheels are mounted.

39. A floor-cleaning robot comprising a wheeled housing defining a housing perimeter;

a motor drive operably connected to wheels of the housing to propel the robot across a floor surface;

an obstacle detector responsive to obstacles encountered by the robot;

a cliff detector disposed adjacent a forward edge of the housing and responsive to floor surface falling edges;

a controller in electrical communication with the obstacle detector, the cliff sensor, and the motor drive, and configured to control the motor drive to redirect motion of the robot in response to detected obstacles and in response to detected floor surface falling edges encountered during a floor-cleaning operation;

a cleaning head, having mounted therein:

a powered primary brush assembly disposed across a central region of an underside of the housing and positioned to brush the floor surface as the robot is propelled across the floor surface, and a vacuum with a vacuum inlet disposed in the underside of the housing rearward of the primary brush assembly; and a powered side brush extending beyond the housing perimeter and positioned to brush floor surface debris from beyond the housing perimeter toward a projected path of the cleaning head.

40. The floor cleaning robot of claim 39 further comprising a particulate receptacle positioned to receive and collect particulates ingested through the vacuum inlet.

41. The floor cleaning robot of claim 40 wherein the receptacle comprises a removable dust cartridge.

42. The floor cleaning robot of claim 39 wherein the vacuum inlet comprises an elongated slot extending across the central region of the underside of the housing.

43. The floor cleaning robot of claim 42 further comprising a first resilient blade extending from the underside of the housing immediately rearward of the vacuum inlet slot and having a distal edge configured to wipe the floor surface.

44. The floor cleaning robot of claim 43 further comprising a second resilient blade extending from the underside of the housing immediately forward of the vacuum inlet slot.

45. The floor cleaning robot of claim 39 wherein the primary brush assembly is configured to rotate about an axis generally parallel to the floor surface and wherein the side brush is configured to rotate about an axis generally perpendicular to the floor surface.

46. The floor cleaning robot of claim 39 further comprising at least one friction pad secured to the underside of the housing and positioned to engage the floor surface and inhibit robot motion when a forward wheel of the robot travels beyond a falling edge of the floor surface.

47. The floor cleaning robot of claim 39 wherein the obstacle detector comprises a displaceable bumper disposed at the housing perimeter, and a bumper displacement sensor responsive to displacement of the bumper with respect to the housing.

48. The floor cleaning robot of claim 47 wherein the bumper displacement sensor comprises an infrared break beam sensor.

49. The floor cleaning robot of claim 39 wherein the side brush assembly comprises bristles extending from a driven hub.

50. The floor cleaning robot of claim 49 wherein the hub has laterally extending brush arms from which the bristles extend.

51. The floor cleaning robot of claim 39 wherein the controller is configured to move the robot in a wall-following mode to maneuver the robot along a wall in a direction that places the side brush against the wall.

52. The floor cleaning robot of claim 39 wherein the housing perimeter is round.

53. The floor cleaning robot of claim 39 wherein the primary brush assembly is mounted on a deck pivotally coupled to a portion of the housing to which the wheels are mounted.

54. The floor cleaning robot of claim 39 wherein the motor drive comprises separate motors operably connected to respective wheels of the housing, the controller configured to independently drive the separate motors to turn the robot.

55. A self-propelled floor-cleaning robot comprising:

wheels operably connected to a motor drive to propel the robot across the floor surface;

a controller in electrical communication with the motor drive and configured to control the motor drive to autonomously maneuver the robot about detected obstacles encountered on the floor surface during a floor-cleaning operation;

a housing defining a round housing perimeter shaped to allow the robot to freely turn when proximate to the obstacles encountered on the floor surface during a floor-cleaning operation;

a cleaning head disposed within the round housing perimeter and positioned to engage a floor surface; and a powered rotating side brush extending beyond the round housing perimeter and positioned to brush floor surface debris from beyond the round housing perimeter toward a projected path of the cleaning head, the powered rotating side brush rotating in a direction that brushes debris toward the robot ahead of a rotating axis of the brush along the projected path of the cleaning head, the controller being configured to move the robot in a wall-following mode to maneuver the robot along a wall in a direction that places the powered rotating side brush against the wall.

56. The floor cleaning robot of claim 55 wherein the cleaning head comprises a powered primary brush assembly disposed within the housing perimeter and positioned to engage the floor surface.

57. The floor cleaning robot of claim 55 wherein the cleaning head comprises a vacuum with a vacuum inlet disposed in the underside of the housing and cooperative with the primary brush assembly.

58. The floor cleaning robot of claim 57 further comprising a particulate receptacle positioned to receive and collect particulates ingested through the vacuum inlet.

59. The floor cleaning robot of claim 58 wherein the receptacle comprises a removable dust cartridge.

60. The floor cleaning robot of claim 57 wherein the vacuum inlet comprises an elongated slot extending across the central region of the underside of the housing.

61. The floor cleaning robot of claim 60 further comprising a first resilient blade extending from the underside of the housing immediately rearward of the vacuum inlet slot and having a distal edge configured to wipe the floor surface.

62. The floor cleaning robot of claim 55 further comprising a cliff detector responsive to an encounter of the robot with a falling edge of the floor surface.

* * * * *

UNITED STATES PATENT AND TRADEMARK OFFICE

CERTIFICATE OF CORRECTION

PATENT NO. : 7,571,511 B2
APPLICATION NO. : 10/818073
DATED : August 11, 2009
INVENTOR(S) : Joseph L. Jones It is certified that error appears in the above-identified patent and that said Letters Patent is hereby corrected as shown below:

Col. 16, line 36-37 – in claim 1, after "surface" delete "disposed".

Signed and Sealed this

Sixth Day of October, 2009

David J. Kappos

David J. Kappos
*Director of the United States Patent and Trademark Office*